US011832779B2

(12) United States Patent
Thorne

(10) Patent No.: US 11,832,779 B2
(45) Date of Patent: Dec. 5, 2023

(54) VACUUM CLEANER

(71) Applicant: Origyn LLC, Boston, MA (US)

(72) Inventor: Jason Thorne, Dover, MA (US)

(73) Assignee: Origyn LLC, Boston, MA (US)

( * ) Notice: Subject to any disclaimer, the term of this patent is extended or adjusted under 35 U.S.C. 154(b) by 173 days.

(21) Appl. No.: 17/531,066

(22) Filed: Nov. 19, 2021

(65) Prior Publication Data

US 2022/0160196 A1 May 26, 2022

Related U.S. Application Data

(60) Provisional application No. 63/208,667, filed on Jun. 9, 2021, provisional application No. 63/116,230, filed on Nov. 20, 2020.

(51) Int. Cl.
*A47L 9/04* (2006.01)
*A47L 5/28* (2006.01)
(Continued)

(52) U.S. Cl.
CPC ..... *A47L 9/0477* (2013.01); *A47L 5/225* (2013.01); *A47L 5/28* (2013.01); *A47L 5/30* (2013.01);
(Continued)

(58) Field of Classification Search
CPC ... A47L 5/225; A47L 5/30; A47L 5/32; A47L 9/2857; A47L 9/0072; A47L 9/165;
(Continued)

(56) References Cited

U.S. PATENT DOCUMENTS 4,377,882 A * 3/1983 Dyson ..... A47L 9/322 15/346
6,446,304 B1 * 9/2002 Paterson ..... A47L 9/325 15/410

(Continued)

FOREIGN PATENT DOCUMENTS

DE 3716104 A1 * 11/1988
GB 2461606 A 1/2010

OTHER PUBLICATIONS

Translation of DE 3716104 A1 (Year: 1988).*

(Continued)

*Primary Examiner* — Brian D Keller
*Assistant Examiner* — Steven Huang
(74) *Attorney, Agent, or Firm* — Finch & Maloney PLLC

(57) ABSTRACT

A vacuum cleaner includes a first tube and a second tube positioned within the first tube, where a first end of the first tube is connected to an outlet of the backbone and a first end of the second tube connected to an inlet of the backbone. A handle is on the first end of the first tube. When the backbone is in a retracted position the first end of the first tube surrounds the second end of the second tube, the second end of the second tube obstructs the outlet of the backbone, and the second end of the first tube surrounds the first end of the second tube. When the backbone is in an extended position the second end of the first tube aligns with the second end of the second tube, leaving the outlet of the backbone unobstructed to a dustcup. A floor nozzle is connected to the inlet of the backbone and includes a nozzle motor configured to operate a brush roll axle and a casing that provides an airpath to the inlet of the backbone.

3 Claims, 28 Drawing Sheets

(51) Int. Cl.

| | |
|---|---|
| ***A47L 9/16*** | (2006.01) |
| ***A47L 5/30*** | (2006.01) |
| ***A47L 5/22*** | (2006.01) |
| ***A47L 9/24*** | (2006.01) |
| ***A47L 9/32*** | (2006.01) |

(52) U.S. Cl.
CPC ..... *A47L 9/0411* (2013.01); *A47L 9/165* (2013.01); *A47L 9/1683* (2013.01); *A47L 9/244* (2013.01); *A47L 9/325* (2013.01)

(58) Field of Classification Search
CPC ..... A47L 9/1691; A47L 9/24; A47L 9/242; A47L 9/244; A47L 9/246; A47L 9/248
USPC ..... 15/331, 334, 335
See application file for complete search history.

(56) References Cited

U.S. PATENT DOCUMENTS

| | | | | |
|---|---|---|---|---|
| 8,042,224 | B2 * | 10/2011 | White | A47L 9/244 15/328 |
| 11,540,681 | B2 * | 1/2023 | Dahlbeck | A47L 5/225 |
| 2001/0002499 | A1 * | 6/2001 | Lindquist | A47L 13/502 15/310 |
| 2003/0167595 | A1 * | 9/2003 | Jin | A47L 9/327 15/410 |
| 2006/0021184 | A1 * | 2/2006 | Hawkins | A47L 9/122 15/377 |
| 2006/0230572 | A1 * | 10/2006 | Lee | A47L 5/32 15/334 |
| 2006/0230715 | A1 * | 10/2006 | Oh | A47L 9/1691 55/337 |
| 2008/0196366 | A1 * | 8/2008 | Conrad | A47L 9/1683 55/337 |
| 2009/0089959 | A1 | 4/2009 | Lee et al. | |
| 2015/0223650 | A1 | 8/2015 | Krebs | |
| 2016/0174787 | A1 * | 6/2016 | Conrad | A47L 5/225 15/329 |
| 2019/0125147 | A1 * | 5/2019 | Svantesson | A47L 5/225 |
| 2019/0167058 | A1 * | 6/2019 | Cho | A47L 9/2884 |
| 2019/0274499 | A1 | 9/2019 | Ford et al. | |

OTHER PUBLICATIONS

European Patent Office, Partial International Search Report issued in International patent application No. PCT/US2022/032826 (dated Oct. 12, 2022).

* cited by examiner

VACUUM CLEANER

RELATED APPLICATIONS

This application claims the benefit under 35 U.S.C. § 119(e) of U.S. Provisional Patent Application No. 63/208,667, filed on Jun. 9, 2021, and titled HYBRID VACUUM CLEANER, and of U.S. Provisional Patent Application No. 63/116,230, filed on Nov. 20, 2020, and titled TELESCOPING HYBRID VACUUM, the contents of which are incorporated herein by reference in their entireties.

TECHNICAL FIELD

This application is directed to a vacuum cleaner. More specifically, this application is directed to a vacuum cleaner having a telescoping air duct.

BACKGROUND

Many varieties of vacuum cleaners exist, the most common options being upright and stick vacuum cleaners. Upright vacuum cleaners have a large dustcup capacity and superior suction. Stick vacuum cleaners are lightweight, have an obstruction-free design for under-furniture reach, and can be battery operated for easy maneuverability.

SUMMARY

A vacuum cleaner assembly is disclosed. In accordance with one embodiment, the assembly includes a backbone which includes a first tube and a second tube positioned within the first tube. The first tube has a first end connected to an outlet of the backbone and the second tube has a first connected to an inlet of the backbone. A second end of the first tube comprises a first mating stop and a first contact. A second end of the second tube comprises a second mating stop and a second contact. When the backbone is in a retracted position, the first end of the first tube surrounds the second end of the second tube, the second end of the second tube obstructs the outlet of the backbone, and the second end of the first tube surrounds the first end of the second tube. When the backbone is in an extended position, the first mating stop mates with the second mating stop, and the first contact mates with the second contact. In this extended position the second end of the first tube is aligned with the second end of the second tube so that the outlet of the backbone is unobstructed. The backbone also has a control channel affixed to an exterior surface of the first tube. Attached to this control channel is a centerpod that includes a dustcup with an inlet connected to the outlet of the backbone, and a control panel in electrical communication with the control channel of the backbone. The centerpod also includes the vacuum cleaner's motor and power source adapter in electrical communication with the control panel.

The floor nozzle is connected to the inlet of the backbone and includes a third electrical contact in electrical communication with the first and second electrical contacts. The third electrical contact is in electrical communication with a nozzle motor that is configured to operate a brush roll axle. The brush roll axle is configured to control the rotation of a brush roll. The brush roll has a casing molded to enclose the nozzle motor and to partially enclose the brush roll, leaving part of the brush roll exposed to a surface opening and while allowing the brush roll to rotate freely within the casing. The floor nozzle is configured to seal an airpath from the surface opening to the inlet of the backbone.

The vacuum cleaner assembly also includes a handle connected to the first end of the first tube and includes a shaft connecting the first end of the first tube to a grip, an on/off control electrically connected to the first, second, and third contacts, and a mode control mechanically connected to the first and second stops.

In some embodiments, the brush roll further comprises a cantilevered connection joint connecting the brush roll to the casing.

In some embodiments, the brush roll comprises at least one angled ridge configured to assist debris from the surface opening to the airpath of the floor nozzle.

In some embodiments, the handle shaft comprises an above-floor nozzle, that is sealed to the outlet of the backbone and creates a second inlet.

In some embodiments the floor nozzle assembly includes a motor with a drive attached to a gear on an armature, a first cylindrical brush roll is attached to one side of the gear while a second cylindrical brush roll is attached to another side opposing the first side of the gear on the armature. The first and second brush rolls have at least one flexible fin and at least one rough ridge of a first height and second height, respectively, on the exterior surface of the brush roll. The height of the ridge is smaller than the height of the fin and the two components run parallel to one another on the exterior surface of the brush roll. A casing partially encloses the motor, first and second cylindrical brush rolls, and the armature. The positioning of the casing also configures a first gap between the first brush roll and casing and a second gap between the second brush roll and casing.

In some embodiments, the flexible fin and the rough ridge are positioned to gradually coil around the exterior of the first cylindrical brush roll and around the second cylindrical brush roll.

In some embodiments, the rough ridge has at least one row of bristles.

In some embodiments, the first and second cylindrical brush rolls have a semi-smooth coating on the exterior surface.

In other embodiments, the brush roll can have a central armature; a first end of a first cylindrical core attached to a first side of the central armature; a first end of a second cylindrical core attached to a second side opposing the first side of the central armature; a first fin and a first ridge positioned parallel to one another on an exterior surface and spanning from the first end to an opposing second end of the first cylindrical core; and a second fin and a second ridge positioned parallel to one another on an exterior surface spanning from the first end to an opposing second end of the second cylindrical core.

In some embodiments the first fin and second fin are made of the same flexible material.

In some embodiments the first fin and first ridge are positioned to complete at least one spiral revolution around the circumference of the first cylindrical core, while extending from the first end to the second end of the first cylindrical core. The second fin and second ridge are configured similarly on the second cylindrical core.

In some embodiments, the first fin is taller than the first ridge and the second fin is taller than the second ridge.

The figures depict various embodiments of the present disclosure for purposes of illustration only. Numerous variations, configurations, and other embodiments will be apparent from the following detailed discussion. Furthermore, as will be appreciated, the figures are not necessarily drawn to scale or intended to limit the described embodiments to the specific configurations shown.

DETAILED DESCRIPTION

A vacuum cleaner, in accordance with this disclosure, can exhibit benefits of both an upright and stick vacuum cleaner, in accordance with some embodiments. For example, the shape of the handle can provide a low weight-in-hand user experience. Also, the location of the dustcup can increase its stability and capacity. Further, a telescoping backbone can provide improved reach under and around furniture.

In an example embodiment, the vacuum cleaner comprises a backbone that encases a valve-less air control system. At a first end of the backbone is the brush head (brush roll) and at the opposite end of the backbone is a handle. In some embodiments, between the handle and the brush roll, is the nozzle, gooseneck, and dustcup.

In some embodiments, the vacuum cleaner further comprises a control system. In some embodiments the control system is housed in the dustcup or in an independent housing attached to the backbone of the vacuum cleaner. In some embodiments, the vacuum cleaner further comprises an on-off switch, or a high-low power switch. In some embodiments, the control system distributes power to the dustcup motor as well as the brush head motor. In some embodiments, the control system is configured to receive input signals from the on-off switch, the high-low power switch, an extended mode catch, a retracted mode catch, and a sensing wheel. In the same or alternative embodiments, the control system is configured to output signals to a motor housed in the dustcup, the dustcup motor, and a motor housed in the brush head, the brush head motor.

Figure 1A:
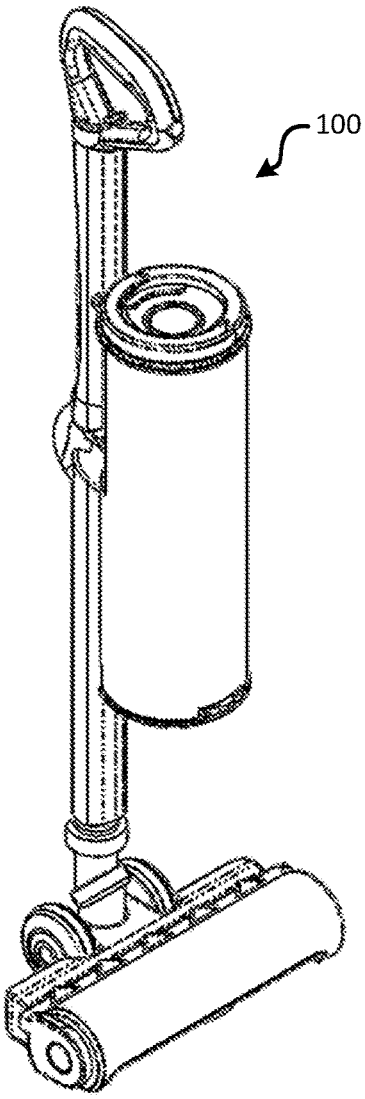
FIG. 1A illustrates a side perspective view of a vacuum cleaner in a retracted state, in accordance with an embodiment of the present disclosure.
Figure 1B:
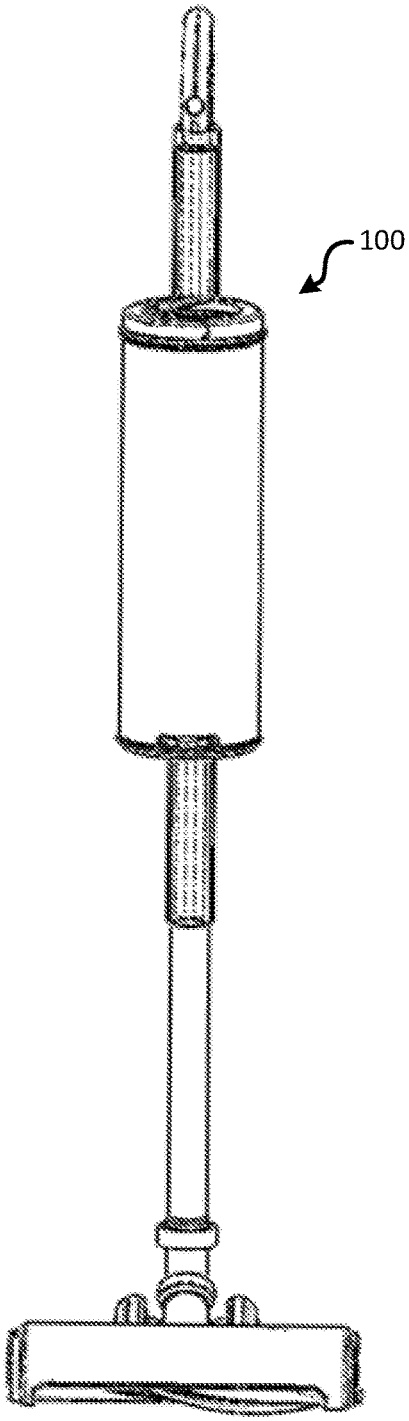
FIG. 1B illustrates a front perspective view of a vacuum cleaner in an extended state, in accordance with an embodiment of the present disclosure.
Figure 1C:
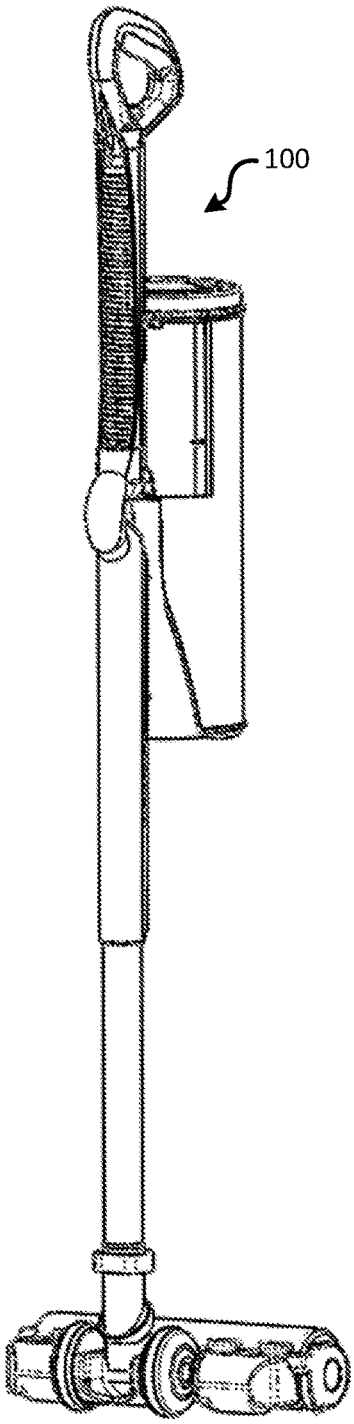
FIG. 1C illustrates a rear perspective view of a vacuum cleaner in an extended state, in accordance with an embodiment of the present disclosure.
Figure 2A:
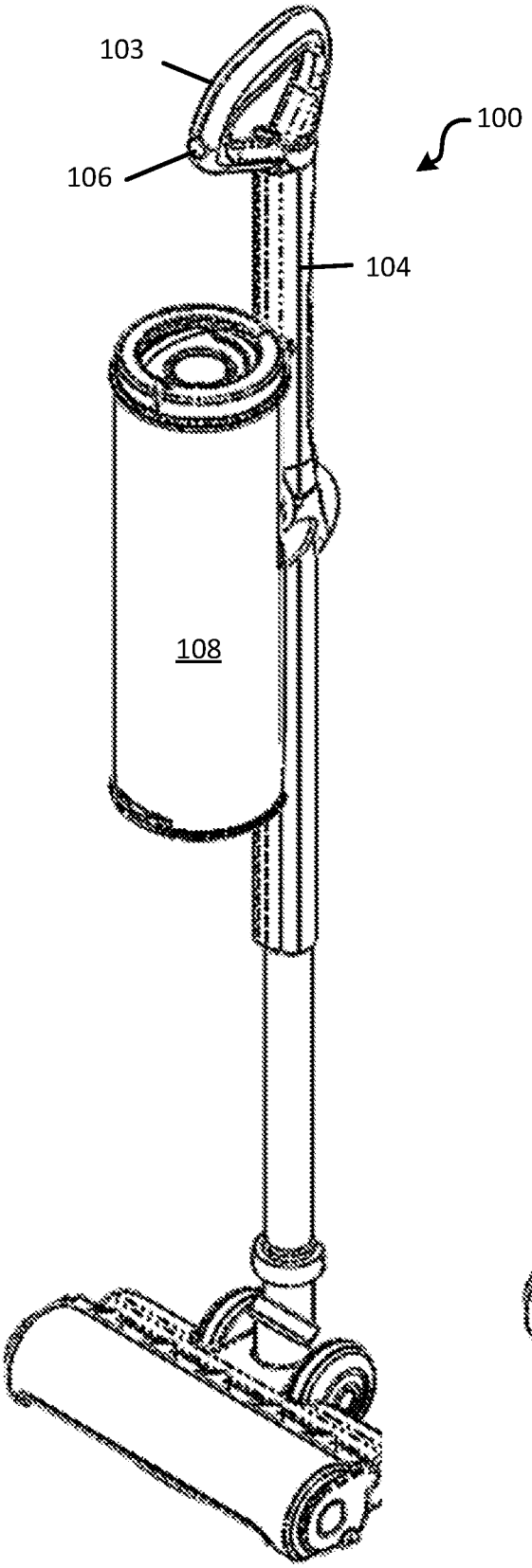
FIG. 2A illustrates a perspective view of a vacuum cleaner in an extended state, in accordance with an embodiment of the present disclosure.
Figure 2B:
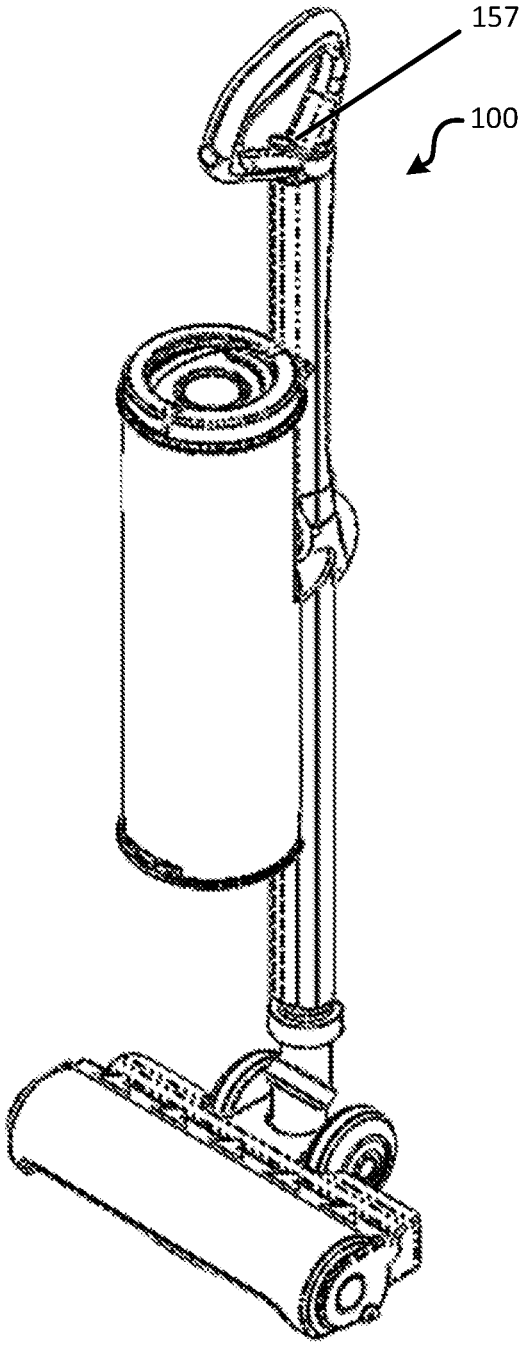
FIG. 2B illustrates a perspective view of a vacuum cleaner in a retracted state, in accordance with an embodiment of the present disclosure.
Figure 3:
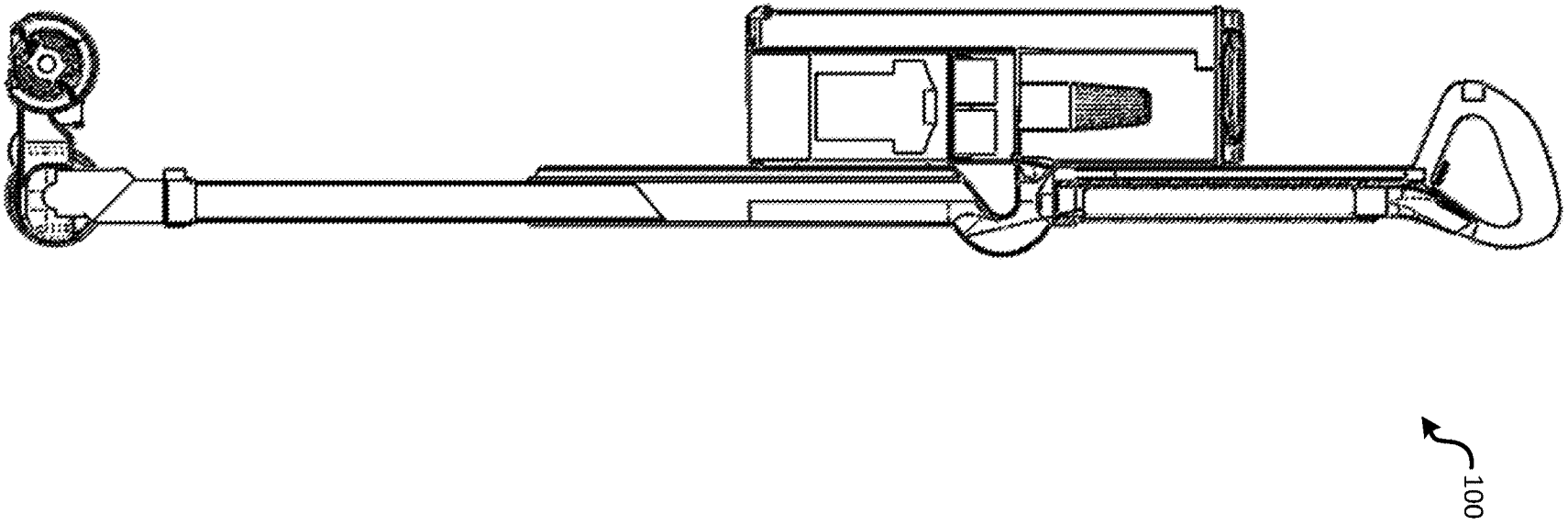
FIG. 3 illustrates a side view of a vacuum cleaner, in accordance with an embodiment of the present disclosure.
Figure 4A:
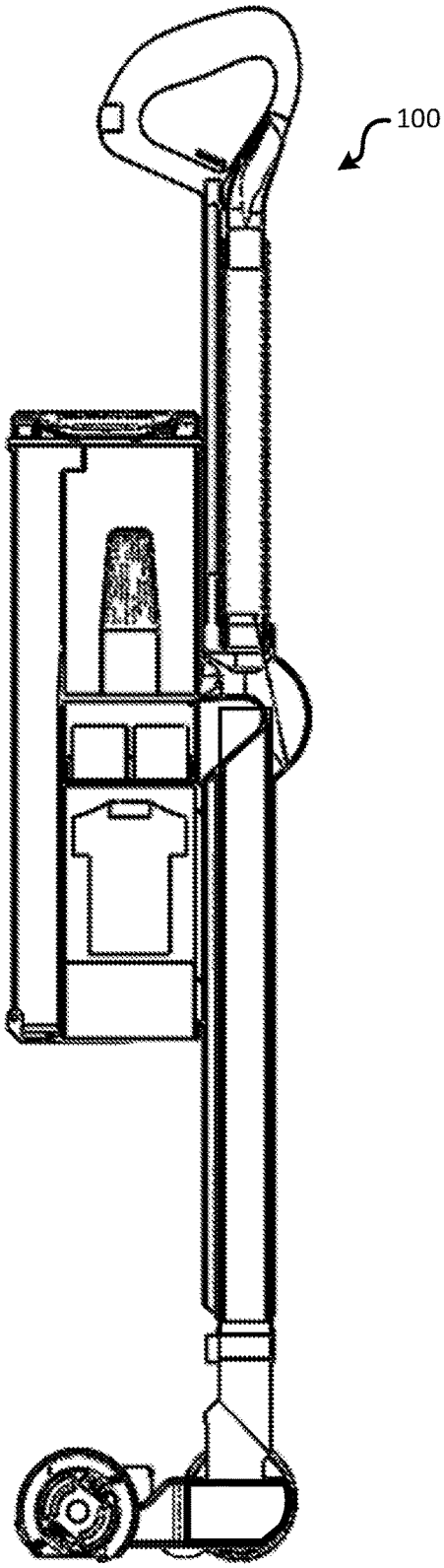
FIG. 4A illustrates a side view of a vacuum cleaner, in accordance with an embodiment of the present disclosure.
Figure 4B:
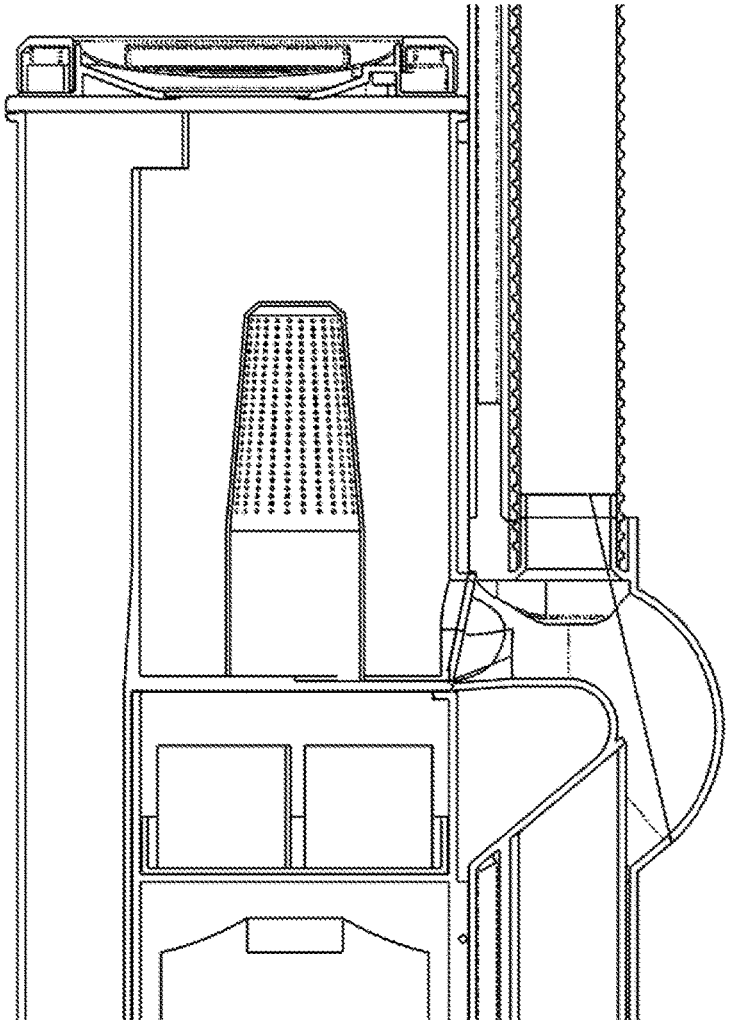
FIG. 4B illustrates an enlarged side view showing the gooseneck, backbone output, and dustcup input of the vacuum cleaner of FIG. 4A.

In some embodiments the backbone of the vacuum cleaner comprises two telescoping tubes of differing diameters. The outer tube is of a larger diameter than the inner tube. The inner tube is nested within the outer tube. In some embodiments, the vacuum cleaner comprises two catches, a first catch (extended mode catch) and a second catch (retracted mode catch). The vacuum cleaner further comprises a sliding mechanism connected to the extended mode catch and the retracted mode catch. When the vacuum cleaner is in a retracted mode, as shown in FIG. 1A and FIG. 2B, the sliding mechanism can be engaged, which releases the retracted mode catch, and allows the outer tube to slide up the inner tube until the extended mode catch is engaged, as shown in FIGS. 1B, 1C and 2A, for example.

In some embodiments, the extended mode catch, and the retracted mode catch further comprise electrical contacts. For example, when the extended mode catch is engaged, a signal is sent to the control system signaling the brush head motor to begin rotating. Alternatively, when the extended mode catch is disengaged, a signal is sent to the control system signaling the brush head motor to stop rotating. Each electrical contact alternately can complete an electrical circuit that enables operation of the brush head motor by connecting the brush head motor to the power supply.

In some embodiments, the telescoping tubes, the handle, the dustcup, and the nozzle are all joined at the gooseneck of the vacuum cleaner. In some embodiments, the gooseneck is a large rounded transition that decreases power consumption and airflow losses through the transition. In addition, the curved nature of the gooseneck reduces clogs in the backbone of the vacuum cleaner.

In some embodiments, the nozzle is stored in the backbone of the vacuum cleaner. In some embodiment, the nozzle is stored via a magnetic or clamp closure attached to, or molded as a part of, the backbone. In some embodiments, the nozzle has an inlet and an outlet. The inlet is the start of the retracted airpath, the outlet connects the gooseneck which is connected to the inlet to the dustcup. In some embodiments, where the nozzle is attached and stored in the backbone, the nozzle's inlet is blocked via a nozzle seal. The seal creates an airtight, or semi-airtight, block of the nozzle inlet. In some embodiments, the seal may comprise a polymeric material. In some embodiments, the seal may further comprise a spring that is compressed when the nozzle is stored in the backbone. Thus, the force from the spring counters the force from the airflow of the nozzle. Alternatively, the seal may comprise a gasket to seal the nozzle inlet. The nozzle further comprises a hose, the hose may be greater than 6 inches, greater than 10 inches, greater than 15 inches, greater than 20 inches when compressed and stored in the backbone. In the same or alternative embodiments, the hose may be less than 25 inches, less than 20 inches, less than 15 inches, less than 10 inches, or less than 6 inches when compressed and stored in the backbone. In some embodiments, the nozzle may further comprise a mechanical attachment at hose that accepts multiple cleaning attachments such as a small crevice tool, a long crevice tool, a brush, a brush head, or an upholstery attachment.

In some embodiments, the vacuum cleaner includes a power supply. In these embodiments, the power supply may include a power cord, allowing input from an external power source, or a battery, further enabling mobility of the vacuum cleaner design. For example, a battery used to power the vacuum cleaner may be a 300W BLDC or a 2500 mAh×8 Li-Ion cell battery maybe used.

In some embodiments, where the vacuum cleaner includes a battery as the power supply, the runtime may of the vacuum cleaner be greater than 20 minutes, greater than 30 minutes, greater than 40 minutes, greater than 60 minutes, or greater than 80 minutes. In the same or alternative embodiments, the runtime may be less than 90 minutes, less than 75 minutes, less than 50 minutes, or less than 30 minutes.

Valve-Less Air Control System

Figure 5A:
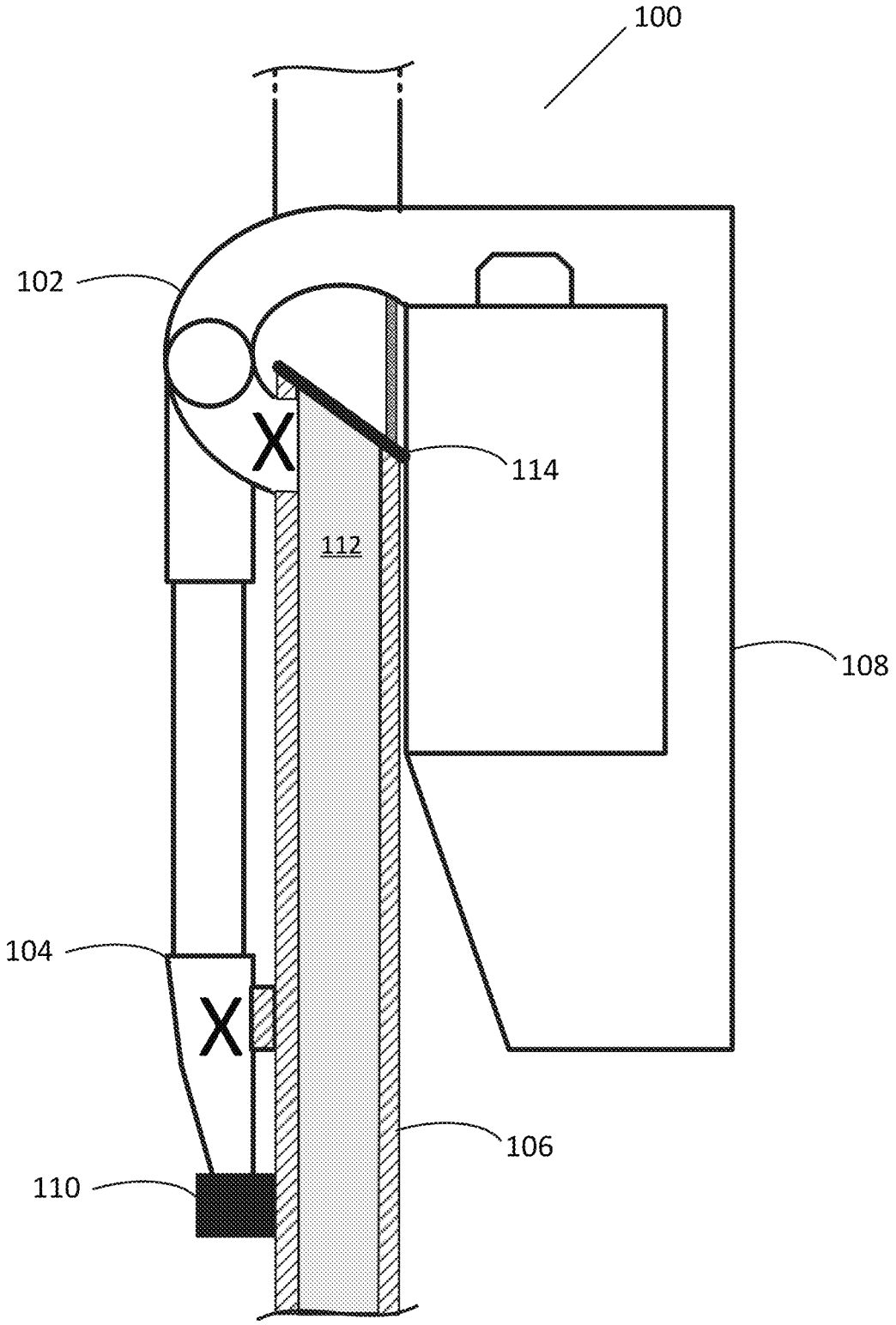
FIG. 5A illustrates a cross-sectional view of an air control system when the vacuum cleaner is in a retracted state, where both the airpath to the hand nozzle and the airpath to the floor nozzle are blocked, in accordance with an embodiment of the present disclosure.
Figure 5B:
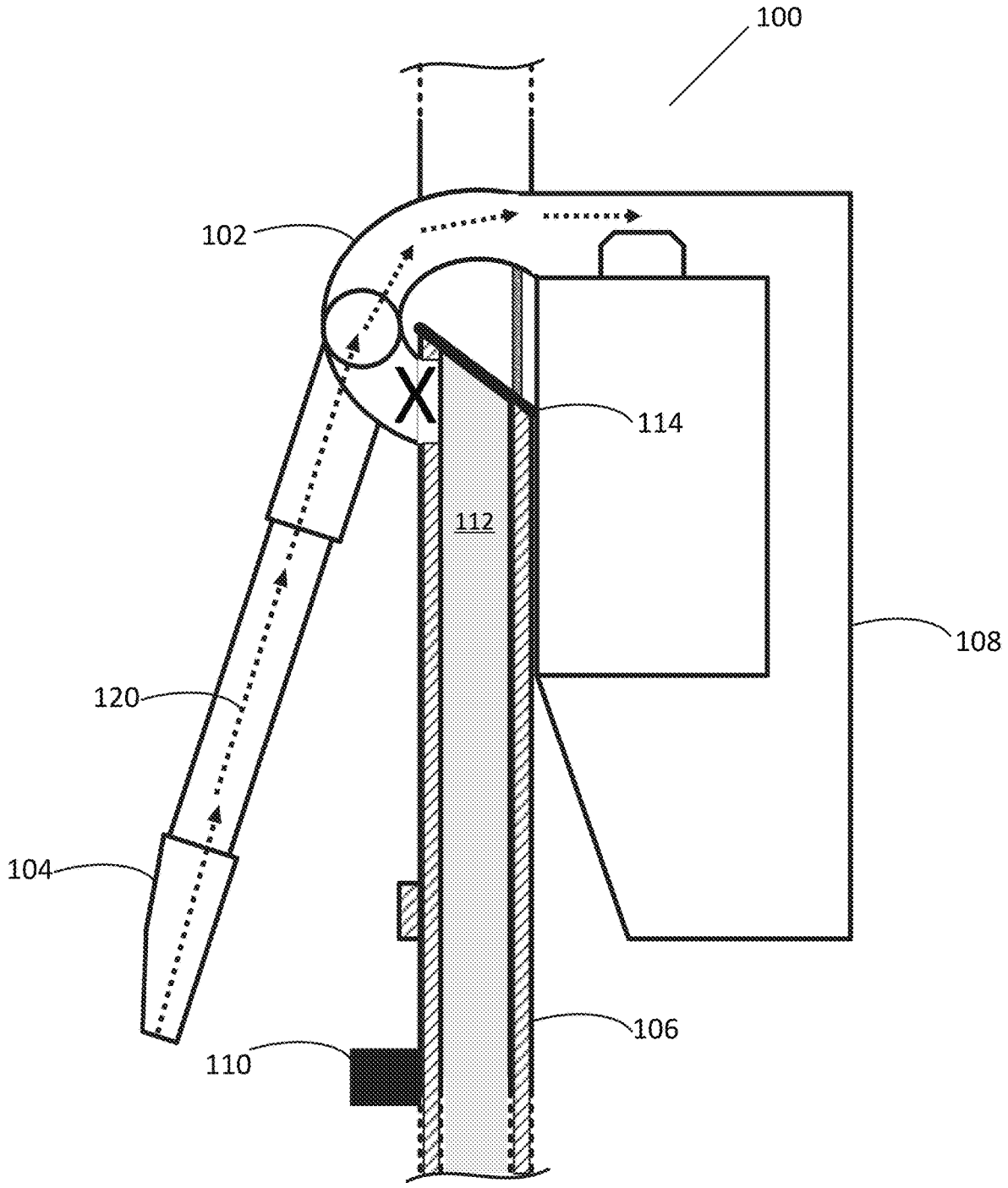
FIG. 5B illustrates a cross-sectional view of the air control system of FIG. 5A when the vacuum cleaner is in the retracted state, where the airpath to the hand nozzle is open and the airpath from the floor nozzle is blocked, in accordance with an embodiment of the present disclosure.
Figure 5C:
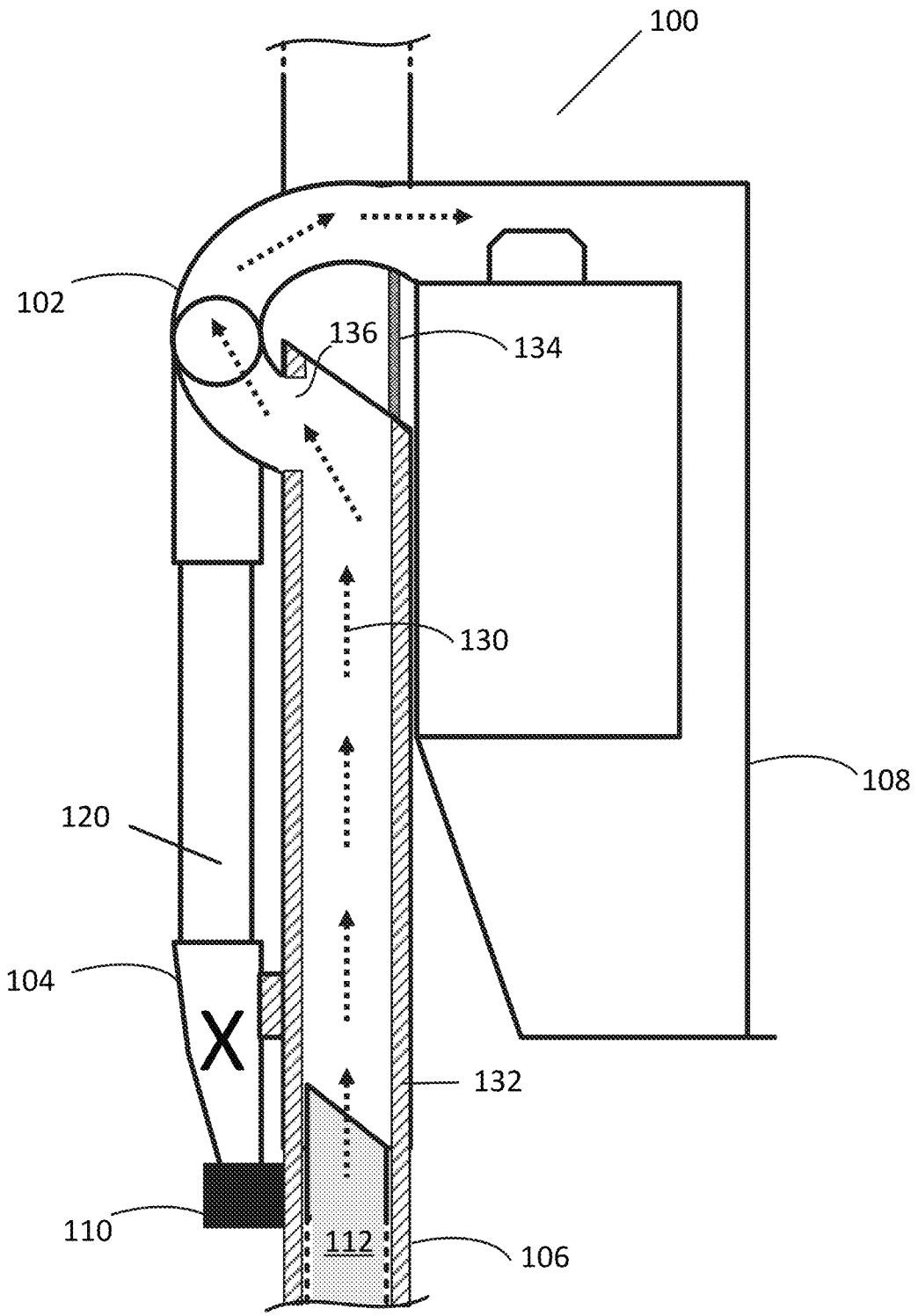
FIG. 5C illustrates a cross-sectional view of the air control system of FIG. 5A when the vacuum cleaner is in the extended state, where the airpath to the hand nozzle is blocked and the extended airpath from the floor nozzle is open, in accordance with an embodiment of the present disclosure.

In some embodiments, the valve-less air control system creates two air paths, a first airpath to a hand nozzle, as depicted in FIG. 5B, and a second, extended airpath to a floor nozzle that can be used for floor surfaces, as depicted in FIG. 5C. As shown in FIG. 5B, the backbone is in the retracted position and the airpath between the dustcup and the hand nozzle 104 is unobstructed, while sealing off the second airpath 112 to the floor nozzle. As shown in FIG. 5C, the second airpath 112 to the floor nozzle is unobstructed between the dustcup and the brush roll, while sealing off the first airpath to the hand nozzle 104.

FIG. 5A, depicts a cross section of the gooseneck 102, nozzle 104, backbone 106, and dustcup 108, in accordance with an embodiment of the present disclosure. In this embodiment, both the retracted and extended airpaths are blocked. In some embodiments, the retracted airpath is blocked by the nozzle seal 110. For example, the opening at the end of the nozzle 104 is closed by contact with the nozzle seal 110, which can be a plug received in the nozzle 104, a quantity of foam, a polymeric plate, or other suitable seal that abuts, covers, or otherwise blocks airflow through the nozzle 104.

In some embodiments, the extended airpath 112 between the dustcup 108 and the floor is blocked by the inner tube 112 occupying the backbone 106 and closing the pathway from the inner tube 112 to the dustcup 108. In some embodiments, the inner tube 112 can engage a backbone seal 114 at the top of the backbone 106 when the vacuum cleaner 100 is in the retracted position.

In some embodiments, the vacuum cleaner further comprises a bleed valve, to prevent overheating when the vacuum cleaner is powered on and both the retracted airpath and the extended airpath are closed. In some embodiments, the bleed valve is housed in the handle, the gooseneck, or the nozzle seal. In the embodiment depicted in FIG. 5A, the bleed valve is in the nozzle seal 110.

FIG. 5B, depicts a cross section of the gooseneck 102, nozzle 104, backbone 106, and dustcup 108, in accordance with an embodiment of the present disclosure. In the embodiment illustrated in FIG. 5B, the first airpath 120 to the hand nozzle 104 is open while the second airpath 112 through the backbone 106 is blocked. The nozzle seal 110 is no longer in contact with the hand nozzle 104, but the inner tube 112 of the backbone 106 is blocking the inlet into the backbone from the gooseneck 102.

FIG. 5C, depicts a cross section of the gooseneck 102, hand nozzle 104, backbone 106, and dustcup 108, in accordance with an embodiment of the present disclosure. In the embodiment illustrated in FIG. 5C, the vacuum cleaner 100 is in the extended position. Accordingly, the first airpath 120 through the hand nozzle 104 is blocked while the second airpath 130 through the backbone 106 is open. In some embodiments, the first airpath 120 is blocked by the nozzle seal 110. In some embodiments, the second airpath 112 is opened by using a sliding mechanism 134, located near the handle, that telescopes the outer tube 132 of the backbone 106 with respect to the inner tube 112 of the backbone, until the backbone 106 engages the extended mode catch. In doing so, the inner tube 112 slides downward within the outer tube 132 so that it no longer obstructs the opening 136 between the outer tube 132 and the gooseneck 102.

Brush Head Design

Figure 6:
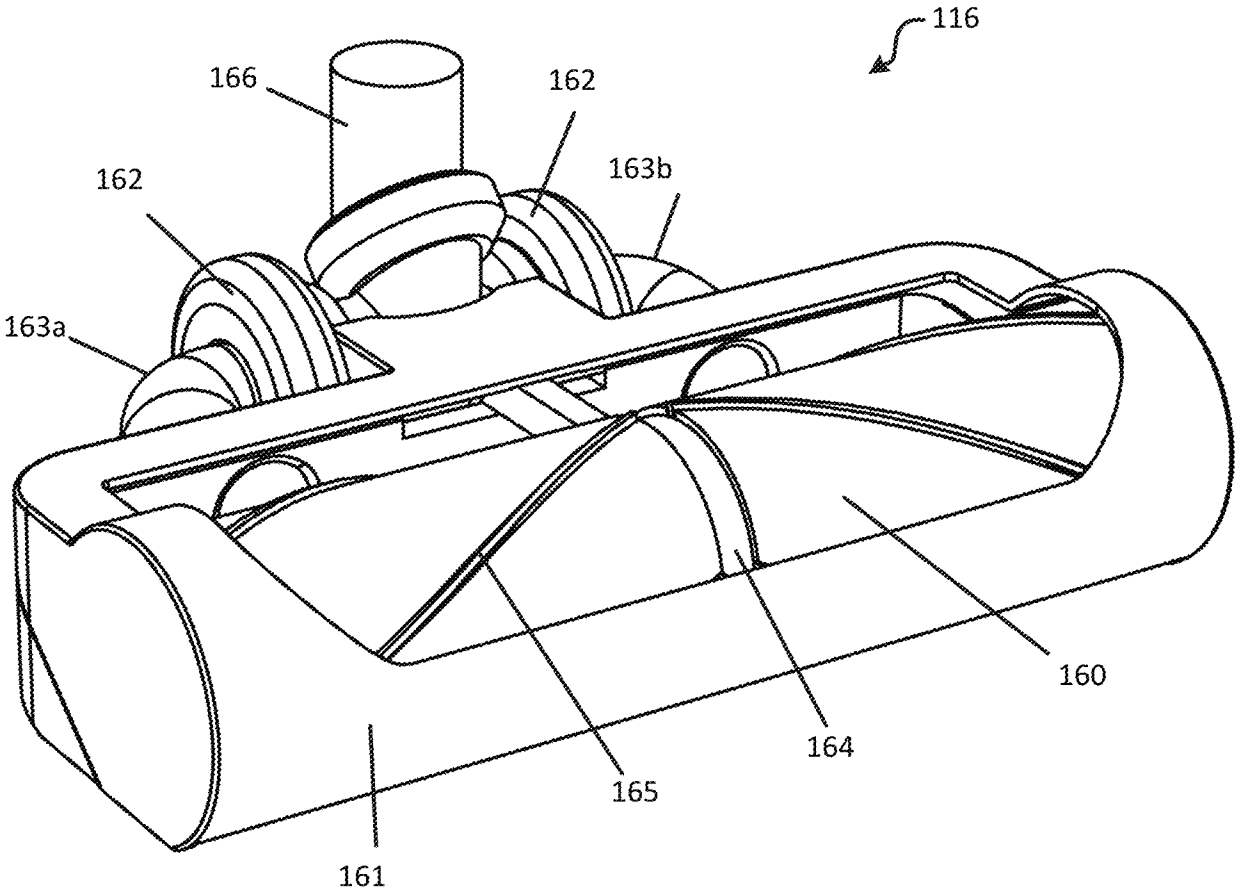
FIG. 6 illustrates a front perspective view of a floor nozzle of a vacuum cleaner, in accordance with an embodiment of the present disclosure.
Figure 7A:
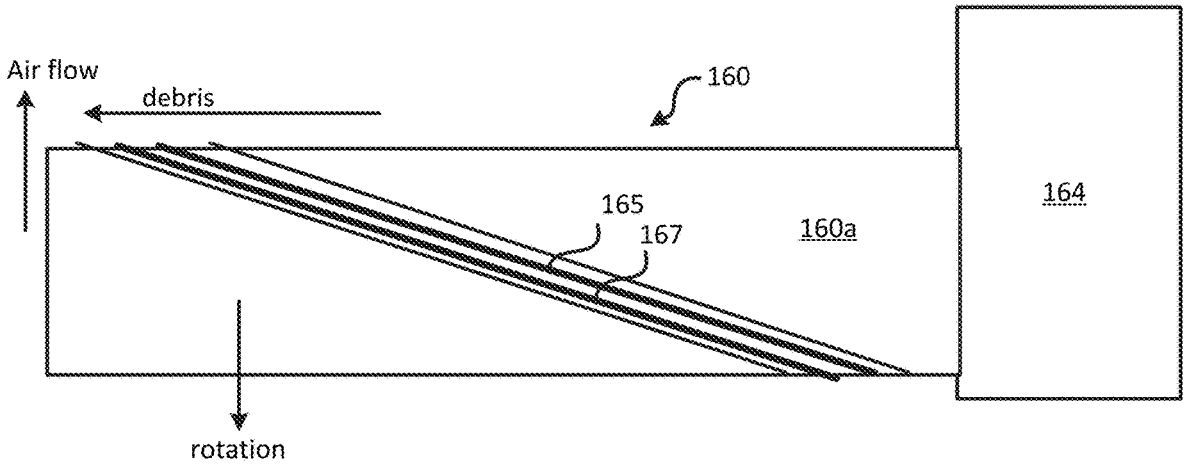
FIG. 7A illustrates a front view of a brush head that can be used with the floor nozzle of FIG. 6.
Figure 7B:
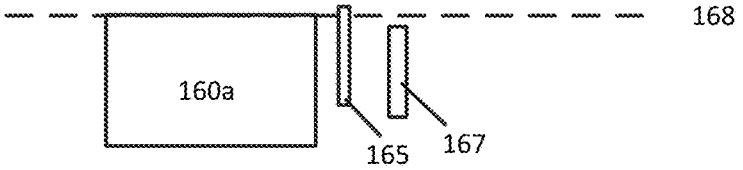
FIG. 7B illustrates a side cross-sectional view of the brush head of FIG. 6.
Figure 7C:
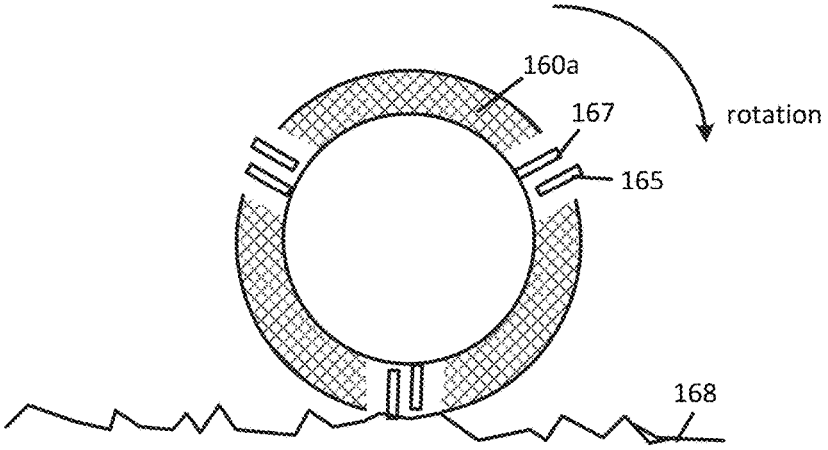
FIG. 7C illustrates a side cross-sectional view of the brush head of FIG. 6 in contact with a surface.

In some embodiments, the floor nozzle 116 includes a brush roll 160 enclosed in a housing 161, such as shown in FIG. 6. In some embodiments, the housing 161 provides suction into two airpaths 163 through the wheels 162 of the brush head to a central, common outlet 166 that connects to a tube in the backbone 106. The brush roll 160 is made of soft felt 160*a*, fins 165 (also referred to as flaps), and bristles 167 (also referred to as ridges), as shown in FIGS. 7A-7C. In some embodiments, the brush roll 160 is cantilevered from a central drive 164. In some embodiments, the brush roll 160, can move up and down on a central armature enabling better carpet cleaning. The brush head design leads to better debris migration to the ends of the brush roll 160 without the need for an added debriding rib. In some embodiments, debris moves along fins 165 because of the angle of the ridge 167 and the interaction with floor surface 168, as shown in FIGS. 7A-7C. As the debris moves to the edge of the cantilevered brush roll 160 it gets sucked into the airpath at the edge of the brush roll but still within the housing 161. This design leads to good edge cleaning performance and a quiet operation. In some embodiments, the brush roll 160 can include rows of tufted bristles 167. As the brush roll rotates, the bristles 167 deform against the floor 168.

In traditional vacuum cleaners, the brush roll is supported on both ends with bearings and being driven on one end through a gear and belt attached to a motor, the brush roll consists of two sections which are cantilevered from a middle section. The motor via a belt connects to a gear on the drive portion through a central armature. This method is known and has been included on some vacuum cleaners for many years. Strands of hair on the floor can get trapped in the bristle tufts then get dragged around the bar resulting in a tight wrapping of the hair around the bar. This is the mechanism by which the brush roll gets laden with pet and human hair. Once a large amount of hair is tightly wrapped around the bar it impacts cleaning performance, looks unsightly, and is very difficult to remove.

The brush roll 160 of the present disclosure reduces or eliminates the hair-wrapping problem of traditional vacuum cleaners by being cantilevered from a central drive 164. In one embodiment, first and second brush rolls are supported on rotating bars extending laterally outward in opposite directions from a central motor or drive 164. The two-bar cantilevered approach means that there are no bearings on the outside end of the brush roll 160 so the bristles 167 can be very close to the outside surface of the brush head. This results in very good edge cleaning, which is the primary benefit of a cantilevered brush roll.

In some embodiments, the flexible fins 165 can be used in combination with bristle tufts 167 and felt 160*a*. The bristles 167 agitate the carpet fibers and the felt 160*a* sweeps hard floor 168. The height of fin 165, bristle 167, or felt 160*a* is such that the bristle 167 does not touch hard floor, such as shown in FIG. 7B, but engages carpet because the wheels on the housing of the brush roll sink into the carpet. The felt 160*a* touches the hard floor but has no detrimental impact on carpet cleaning. The flexible fin 165 is high enough above the floor to prevent hair from going into the root of the bristle tuft or getting trapped in the felt.

In some embodiments, the fin 165 and bristle 167 may be arranged next to each other in multiple spiral rows on the brush rolls 160. The bristle and fin touch the carpet at the end of the roll closest to the central drive system. As the brush roll 160 rotates, the point that touches the carpet moves outwards to the end of the bar. The hair is maintained on the top of the rubber fin and can move sideways without getting stuck on the bristles or felt. As the fin interacts with the carpet fibers, the hair migrates along the fin to the ends of the brush roll. In some embodiments, the hair is bundled into a torus-shaped wrap and then falls off the end of the brush roll because it is unsupported on the ends. In some embodiments, once off the brush roll, the hair then gets sucked away into the airpath between the brush roll and the casing.

In some embodiments, the cantilevered brush roll design is preferred over brush rolls that include debriding teeth because, without debriding teeth, the sound of the brush roll's operation is dampened.

In some embodiments, a rib may be included inside the brush roll housing 161 to encourage the migration of the hair to the ends of the brush roll 160. In some embodiments, the rib could be fixed in place or movable. In some embodiments, the rib could be moveable via an actuating mechanism. In some embodiments, the rib could be a polymeric or natural fiber material.

Figure 8:
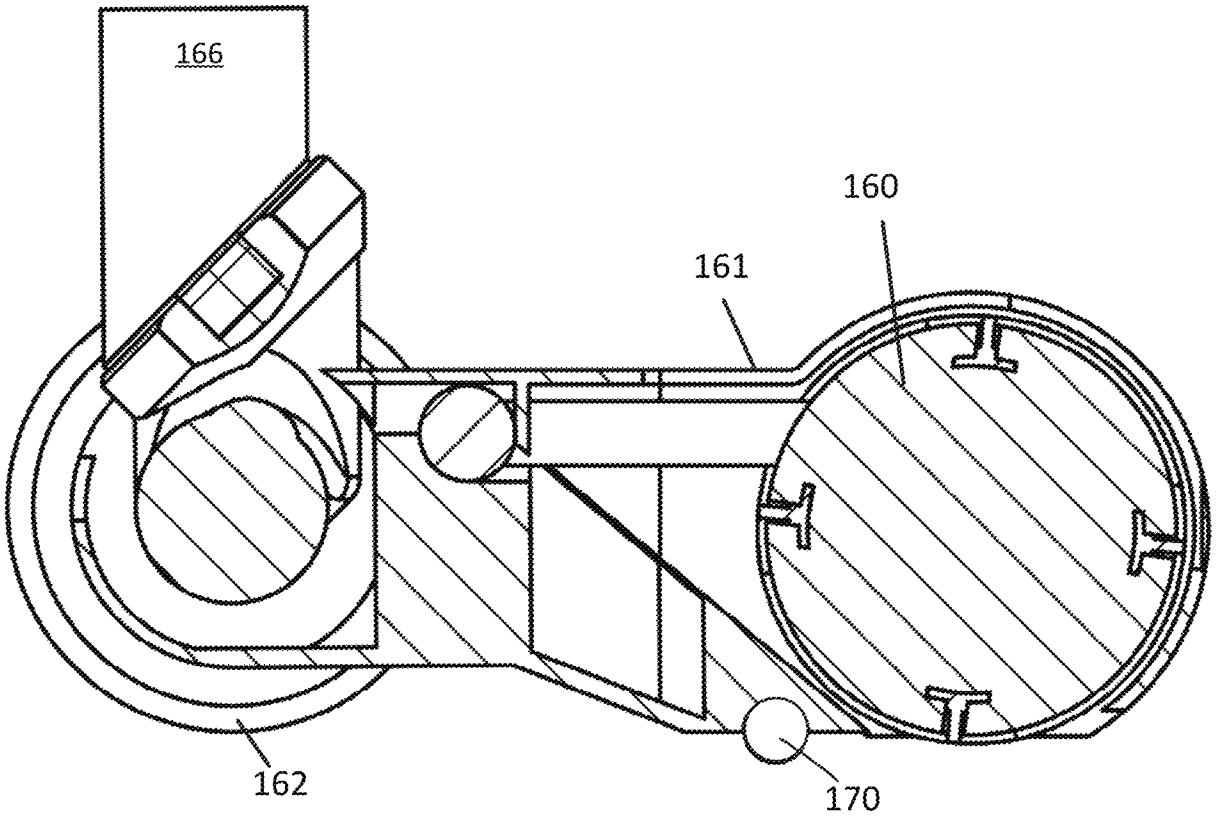
FIG. 8 illustrates a cross-sectional view of the brush head, in accordance with an embodiment of the present disclosure.

In some embodiments, the brush head includes a floor sensing technology to control the vacuum cleaner's power settings. For example, as shown in FIG. 8, the brush head may comprise a sensing wheel 802. The sensing wheel's 802 position may vary depending on the hardness of the surface. For example, if the surface is softer, like a carpet or foam surface, the carpet displaces the wheel 802 to a higher position. Alternatively, if the surface is harder like concrete or hardwood, the wheel 802 is not displaced and occupies a lower position. Depending on the position of the sensing wheel 802 with respect to the chassis or floor, a signal is transmitted to the control system. If the sensing wheel is in the lower position (e.g., use on a hardwood floor) the power output from the power supply to the brush head motor and dustcup motor is increased. Alternatively, if the sensing wheel is in the higher position (e.g., use on carpet) the power output from the power supply to the brush head motor and dustcup motor can be decreased.

In some embodiments, the brush roll may include a central drive system. In some embodiments, the brush roll may include cantilevered rolls. In the same or alternative embodiments, the brush roll and drive assembly could be pivotally floating about a point close to the wheels 162 of the brush head 116. In some embodiments, this floating assembly may have a small wheel 170 on the central portion of the floor nozzle 116 that rides on the floor surface 168 and sets the height of the bristle 167, fin 165 and felt 160*a* to optimize cleaning of that surface type. In some embodiments, the adjustment of the brush roll positioning prevents loud noise, vibration, and potentially surface damage. In some embodiments, the wheel 170 on the central floating portion may sink into soft surfaces, resulting in deeper bristle engagement into the soft surface and better cleaning performance.

Note that hard floor and carpets are used as descriptive terms of a hard and soft surface. The claimed vacuum cleaner can be used on a multitude of surfaces. In addition, hair is used as an example of debris to describe the function of the claimed brush roll design. This design improves cleaning of many other forms of debris, hair is merely one example.

Figure 9A:
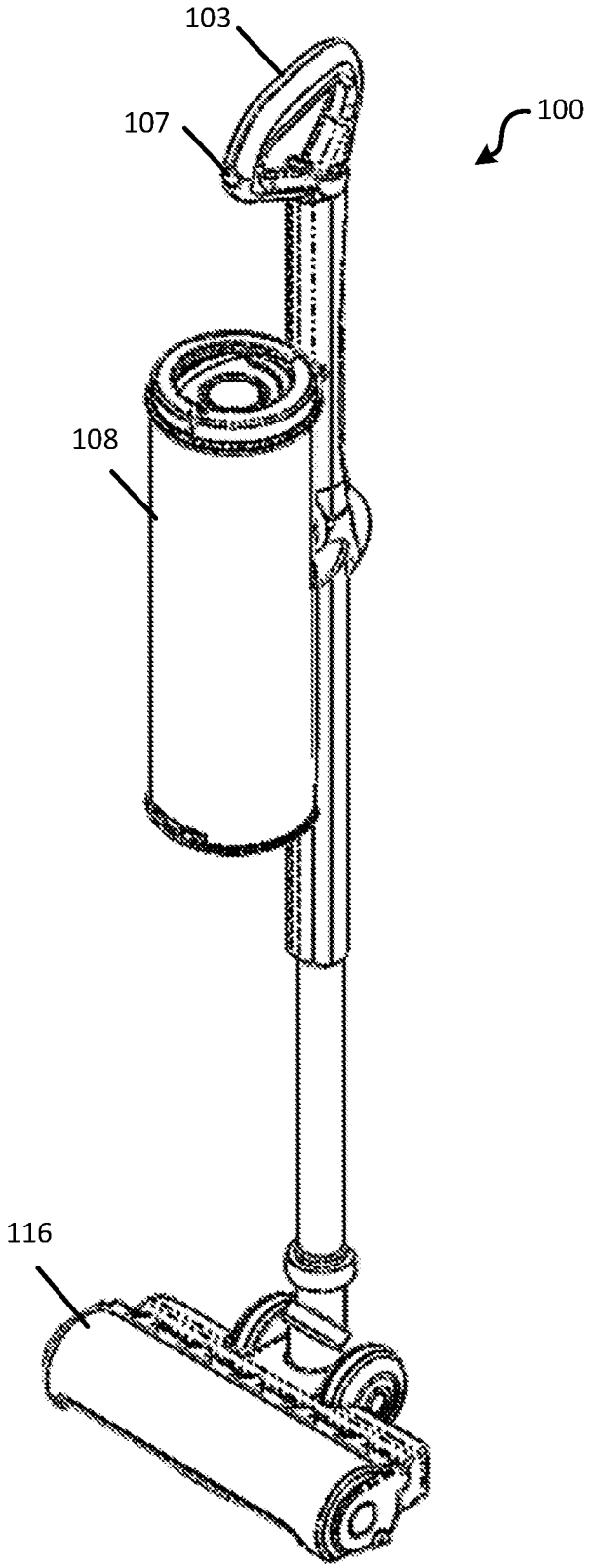
FIGS. 9A and 9B illustrate a perspective view of a vacuum cleaner in an extended state and a retracted state, respectively, in accordance with some embodiments.
Figure 9B:
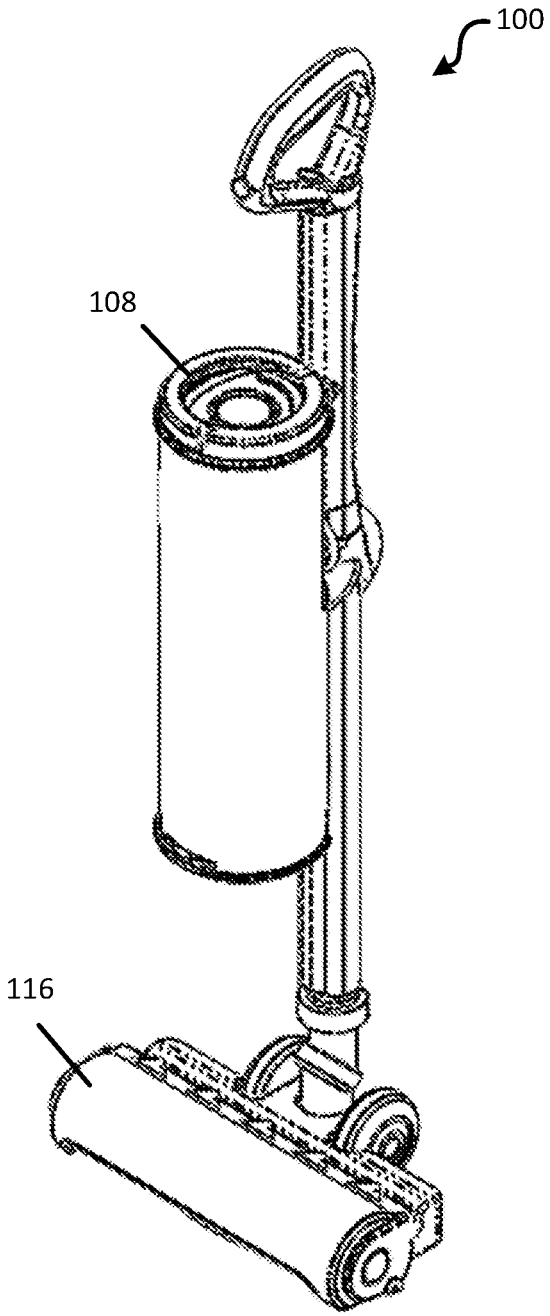

FIGS. 9A and 9B depict perspective views of a vacuum cleaner 100 in an upright position, in accordance with an embodiment of the present disclosure. FIG. 9A depicts the vacuum cleaner 100 in an extended state and FIG. 9B depicts the vacuum cleaner 100 in a retracted state. In this embodiment, the vacuum cleaner assembly includes an on-off switch 107 on the handle 103. When the vacuum cleaner 100 is in an extended state, the airpath is open between the floor nozzle 116 and the dustcup 108. The vacuum cleaner provides the advantage of a low total weight, and when in an extended position, the vacuum assembly can also provide the advantage of a long reach for cleaning difficult-to-reach locations, such as under furniture.

Figure 10:
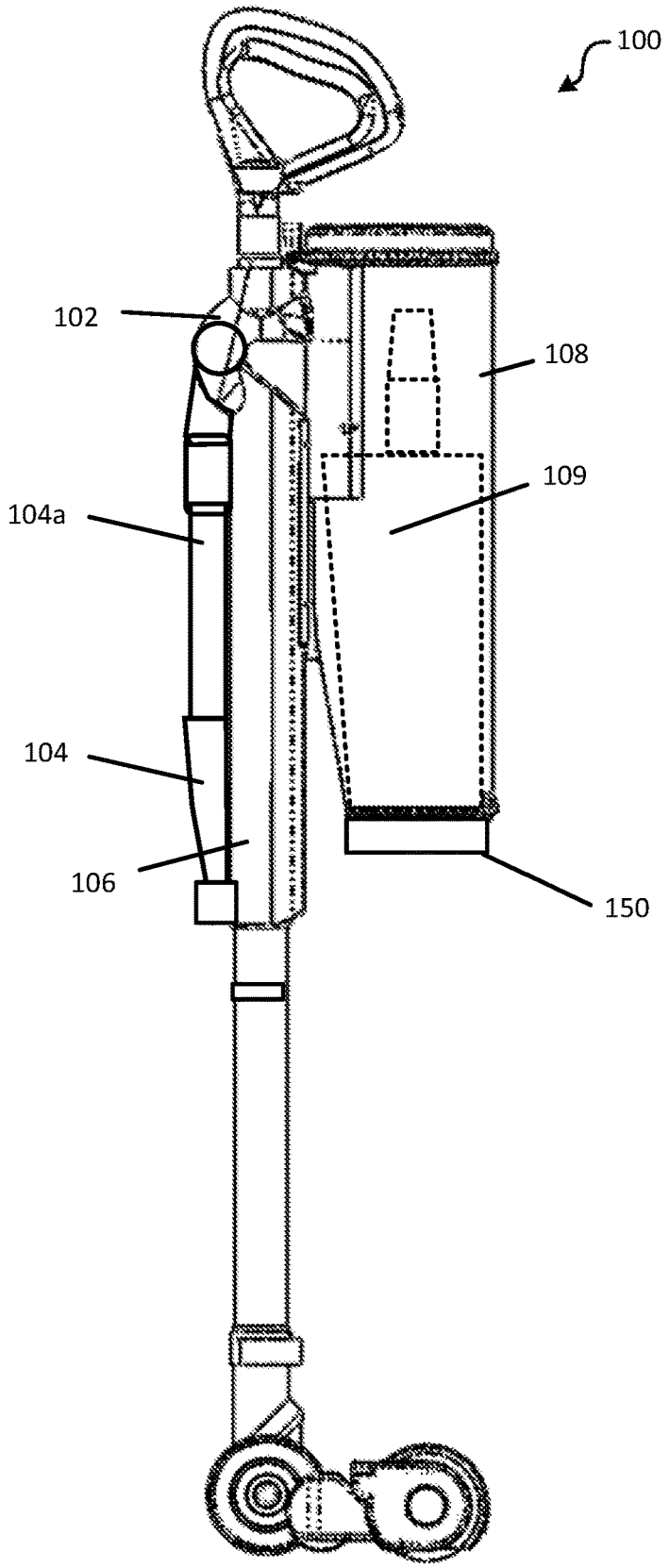
FIG. 10 illustrates a side view of a vacuum cleaner in an extended state, in accordance with an embodiment of the present disclosure.

FIG. 10 depicts a side view of the vacuum cleaner 100, in accordance with an embodiment of the present disclosure. In this embodiment, a removable battery 150 is attached beneath the centerpod 109 and the dustcup inlet 108*a* is at the top of the dustcup 108. In this embodiment the backbone 106 includes inner and outer tubes that telescope between the extended and retracted positions, as noted above. Additionally, the hose of the hand nozzle 104 extends down from the gooseneck 102. This embodiment provides the advantage of the centerpod 109 sitting slightly higher, which provides a longer reach for cleaning difficult-to-reach locations.

Figure 11A:
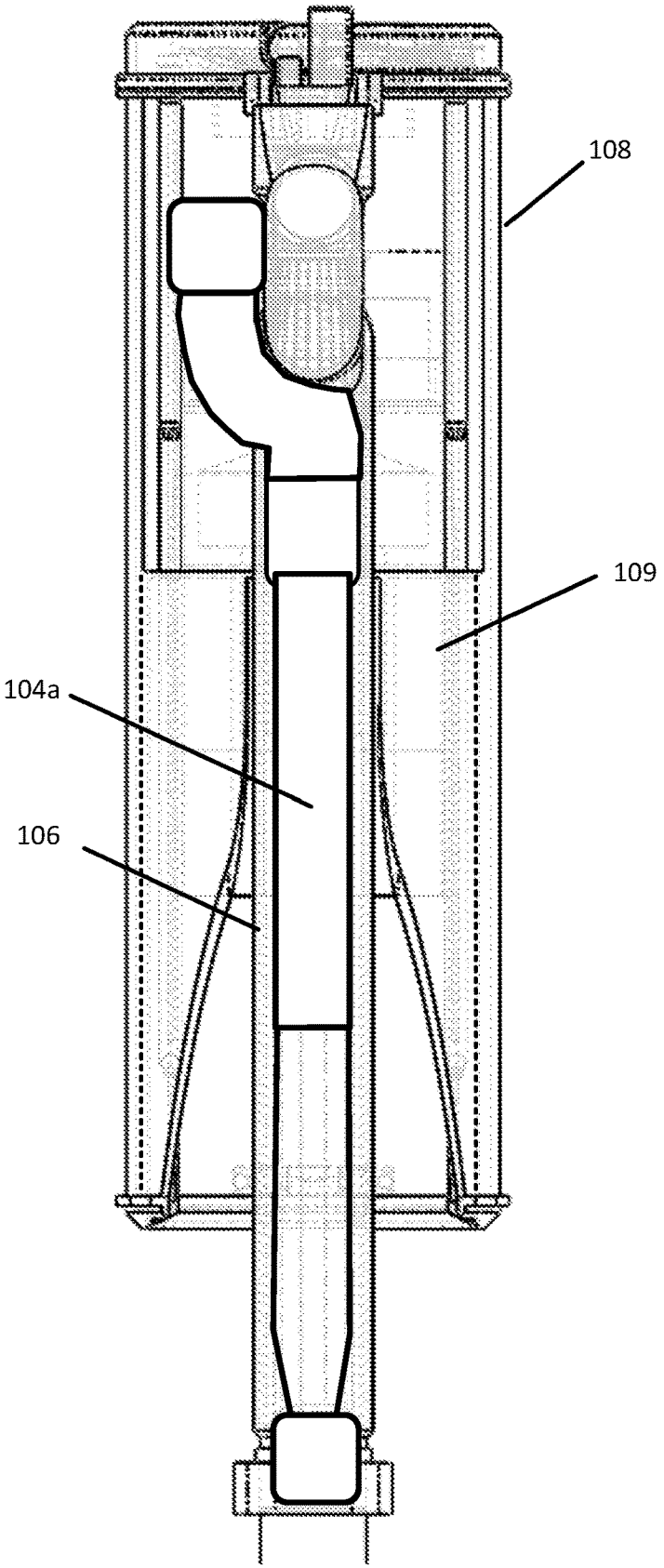
FIG. 11A illustrates a rear view of part of a vacuum cleaner, showing a dustcup and hand nozzle, in accordance with an embodiment of the present disclosure.
Figure 11B:
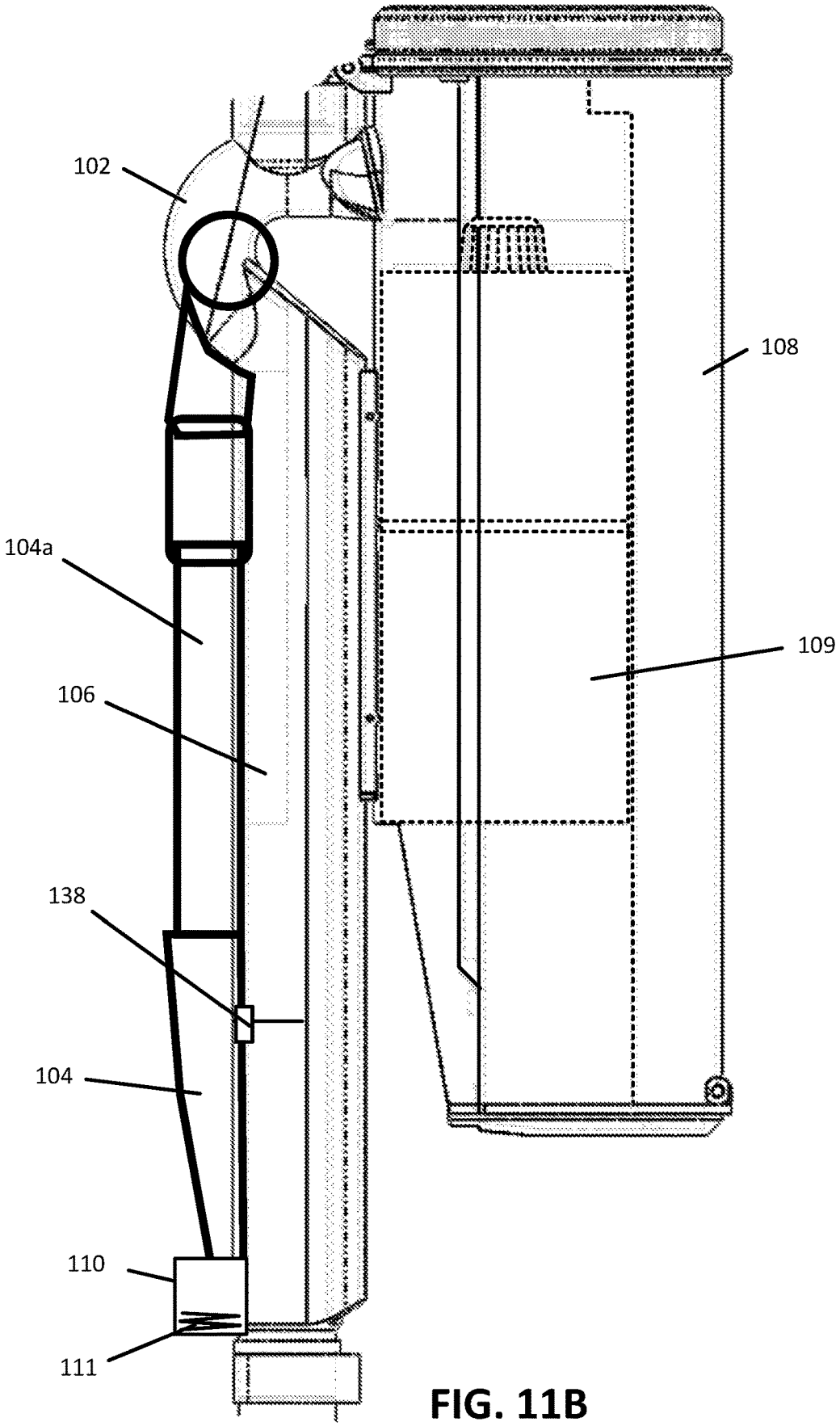
FIG. 11B illustrates a side view of the dustcup of the vacuum cleaner of FIG. 11A.

FIG. 11A and FIG. 11B depict an enlarged view of the dustcup 108 and backbone 106 of the vacuum cleaner 100 assembly, in accordance with an embodiment of the present disclosure. FIG. 11A depicts an enlarged rear view showing the hose 104*a*, backbone, and centerpod 109 of the hybrid vacuum cleaner, in accordance with an embodiment of the present disclosure. In this embodiment, the hose 104*a* is lined up with the backbone 106 to maintain a thin profile from the front. FIG. 11B depicts an enlarged side view showing the centerpod 109 within the dustcup 108, backbone 106, magnets 138, and seal assembly 110 spring of the vacuum cleaner 100, in accordance with an embodiment of the present disclosure. In this embodiment, a spring 111 within the nozzle seal 110 pushes the crevice attachment of the hand nozzle 104 upwards, which condenses the hose 104*a* tightly, thereby keeping the hose 104*a* in place. Additionally, FIG. 11B depicts an embodiment in which magnets 138 may be used to keep the crevice/hand nozzle 104 and hose 104*a* in place. Alternatively, in some embodiments a half-circle form in the backbone 106 may be used to align the hose 104*a*.

Figure 12A:
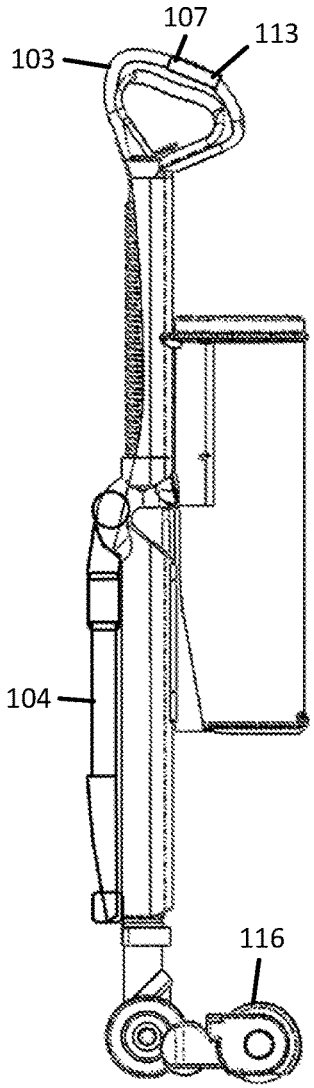
FIG. 12A illustrates a side view of a vacuum cleaner in an extended state, in accordance with an embodiment of the present disclosure.
Figure 12B:
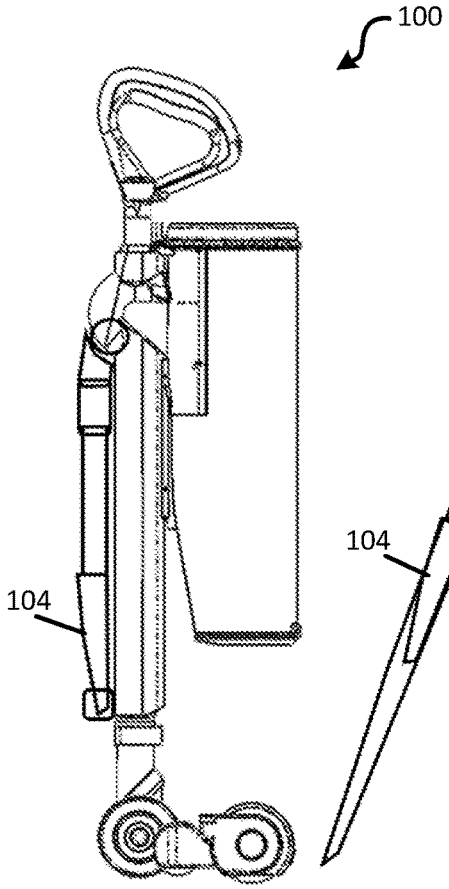
FIG. 12B illustrates a side view of a vacuum cleaner in a retracted state with the hand nozzle stowed, in accordance with an embodiment of the present disclosure.
Figure 12C:
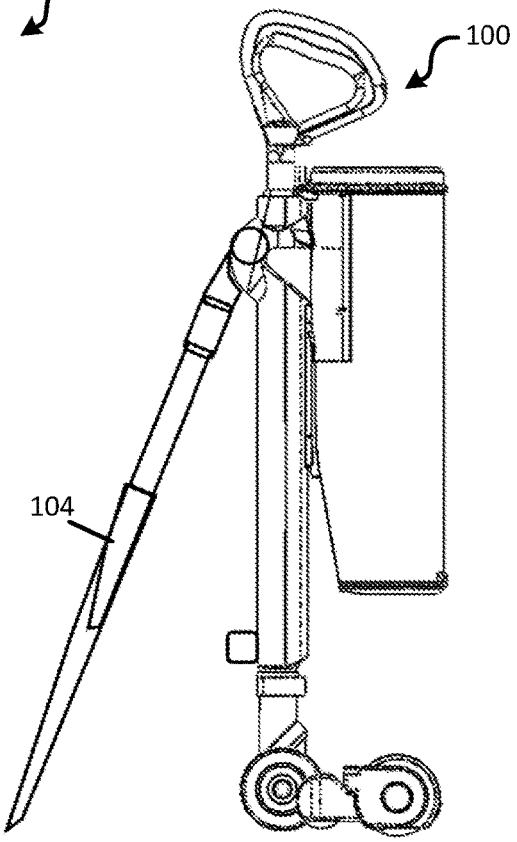
FIG. 12C illustrates a side view of a vacuum cleaner in a retracted state with the hand nozzle in a deployed position, in accordance with an embodiment of the present disclosure.

FIGS. 12A-12C depict side views of the vacuum cleaner 100 assembly in accordance with an embodiment of the present disclosure. In this embodiment, the handle 103 includes an on/off switch 107 and a maximum/minimum switch 113. FIG. 12A depicts a side view of the vacuum cleaner in an extended state and the crevice 104 stored allowing both the suction and the brushroll of the floor nozzle 116 to be on. In this mode, the crevice (a.k.a. hand nozzle 104) is locked and cannot be removed. FIG. 12B depicts a side view of the vacuum cleaner 100 in a retracted state and the crevice 104 stored such that the suction and brushroll are both off. FIG. 12C depicts a side view of the vacuum cleaner 100 in a retracted state and the crevice 104 removed such that the brushroll is off, but the suction is on at a reduced flow. This configuration also gives the maximum run time for embodiments having the electrical controls discussed above.

Figure 13A:
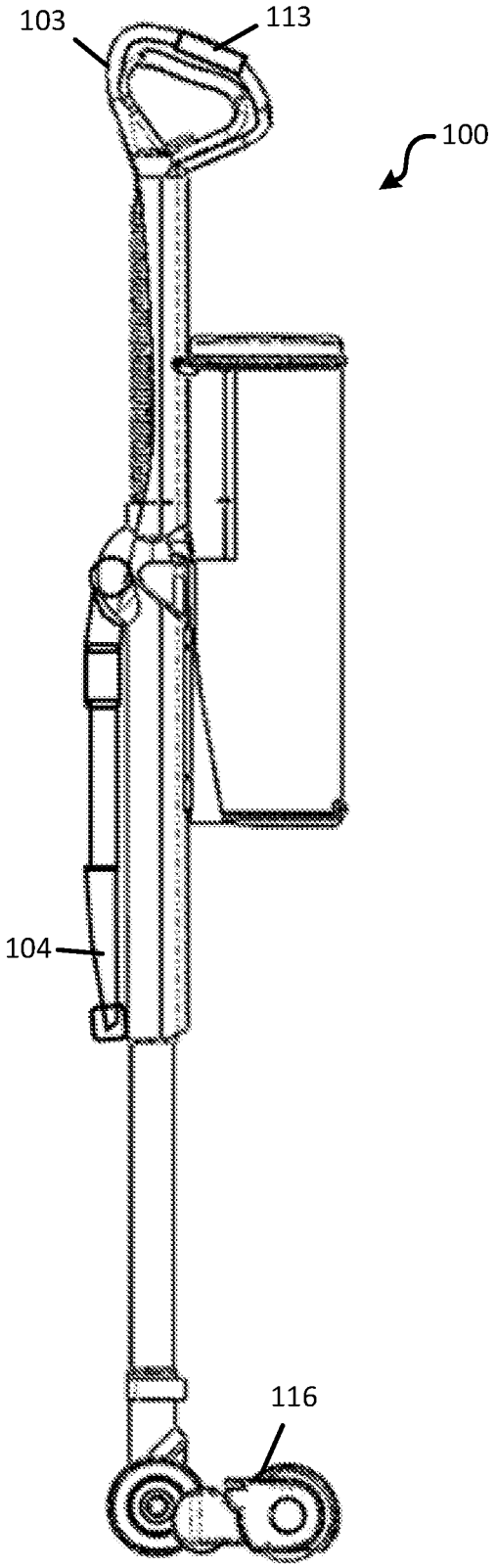
FIG. 13A illustrates a side view of a vacuum cleaner in an extended state and with the hand nozzle in a stowed position, in accordance with an embodiment of the present disclosure.
Figure 13B:
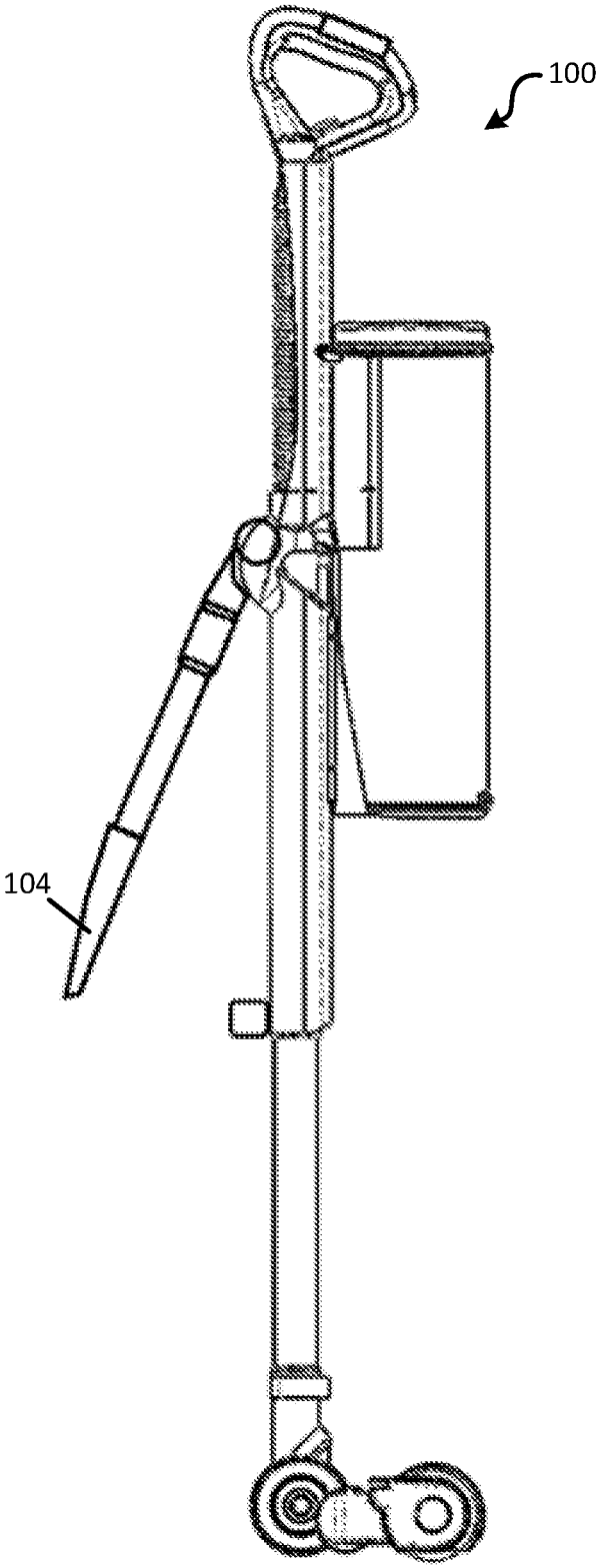
FIG. 13B illustrates a side view of the vacuum cleaner of FIG. 13A in the extended state and with the hand nozzle in a deployed position, in accordance with an embodiment of the present disclosure.

FIGS. 13A-13D depict a side view of the vacuum cleaner 100 assembly, in accordance with another embodiment of the present disclosure. In this embodiment, the controls assembly comprises only a maximum/minimum switch 113 in the handle 103. FIG. 13A depicts a side view of the vacuum cleaner 100 in an extended state with the crevice 104 stored allowing both the suction and the brushroll of the floor nozzle 116 to be on. Also, in this configuration, the crevice 104 is locked and cannot be removed. FIG. 13B depicts a side view of the vacuum cleaner 100 in an extended state with the crevice 104 removed. In this configuration both the suction and the brushroll are off.

Figure 13C:
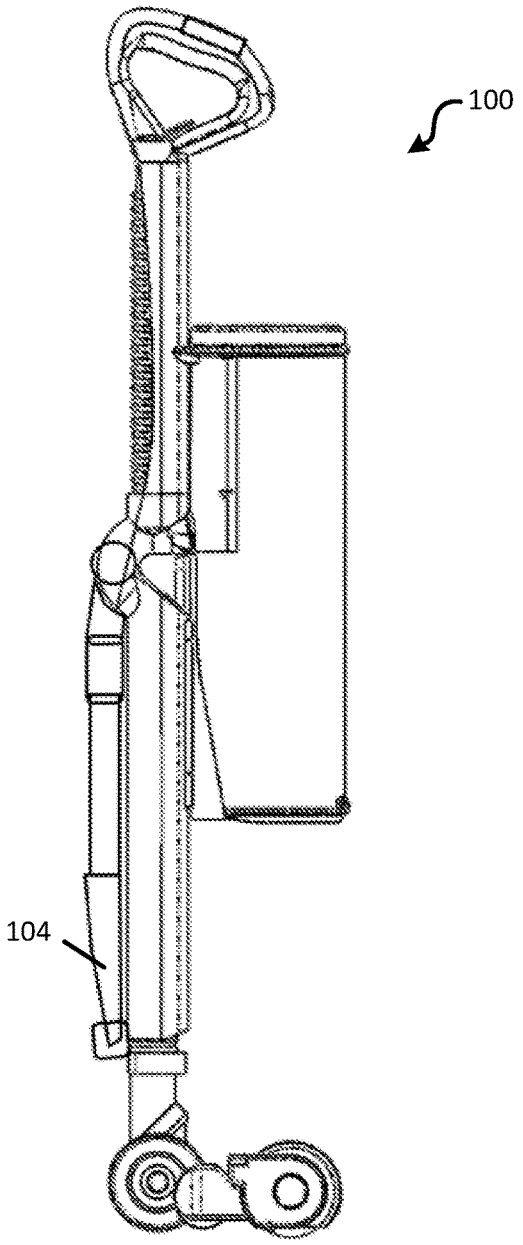
FIG. 13C illustrates a side view of a vacuum cleaner in a retracted state and with the hand nozzle in a stowed position, in accordance with an embodiment of the present disclosure.
Figure 13D:
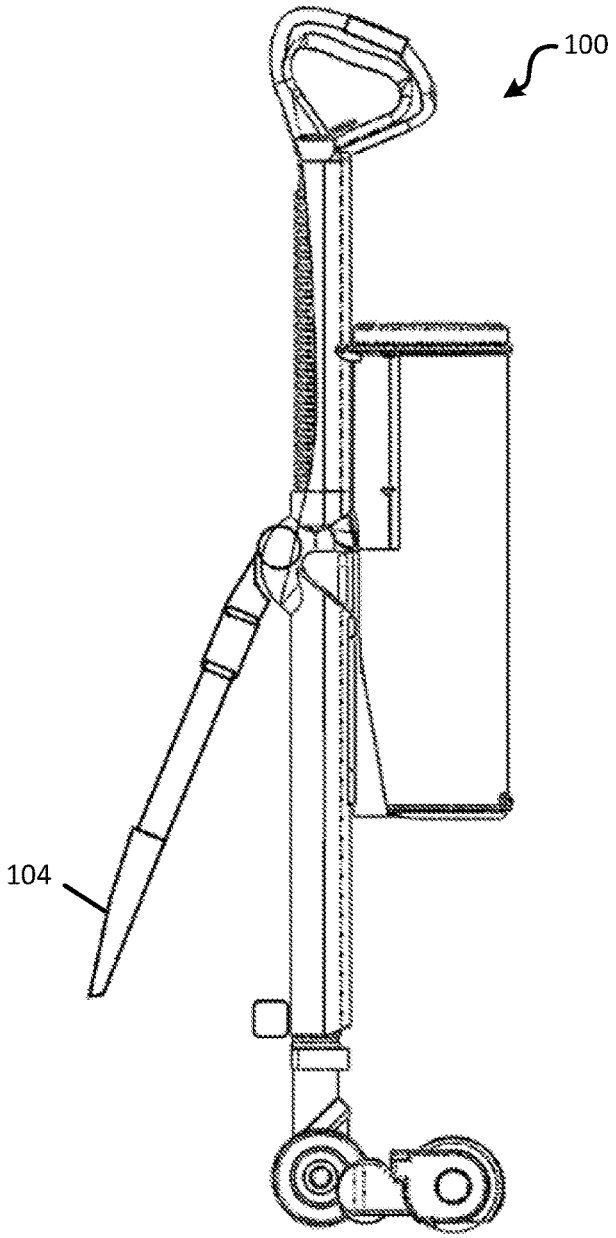
FIG. 13D illustrates a side view of a vacuum cleaner in a retracted state and with the hand nozzle in a deployed position, in accordance with an embodiment of the present disclosure.

FIG. 13C depicts a side view of the vacuum cleaner 100 assembly in a retracted state with the crevice 104 stored. In this configuration the suction and brushroll are both off. FIG. 13D depicts a side view of the vacuum cleaner 100 assembly in a retracted state with the crevice 104 removed. In this configuration the brushroll is off, but the suction is on at a reduced flow. This configuration gives the maximum run time for embodiments having only the max/min switch 113 in the handle 103.

Figure 14:
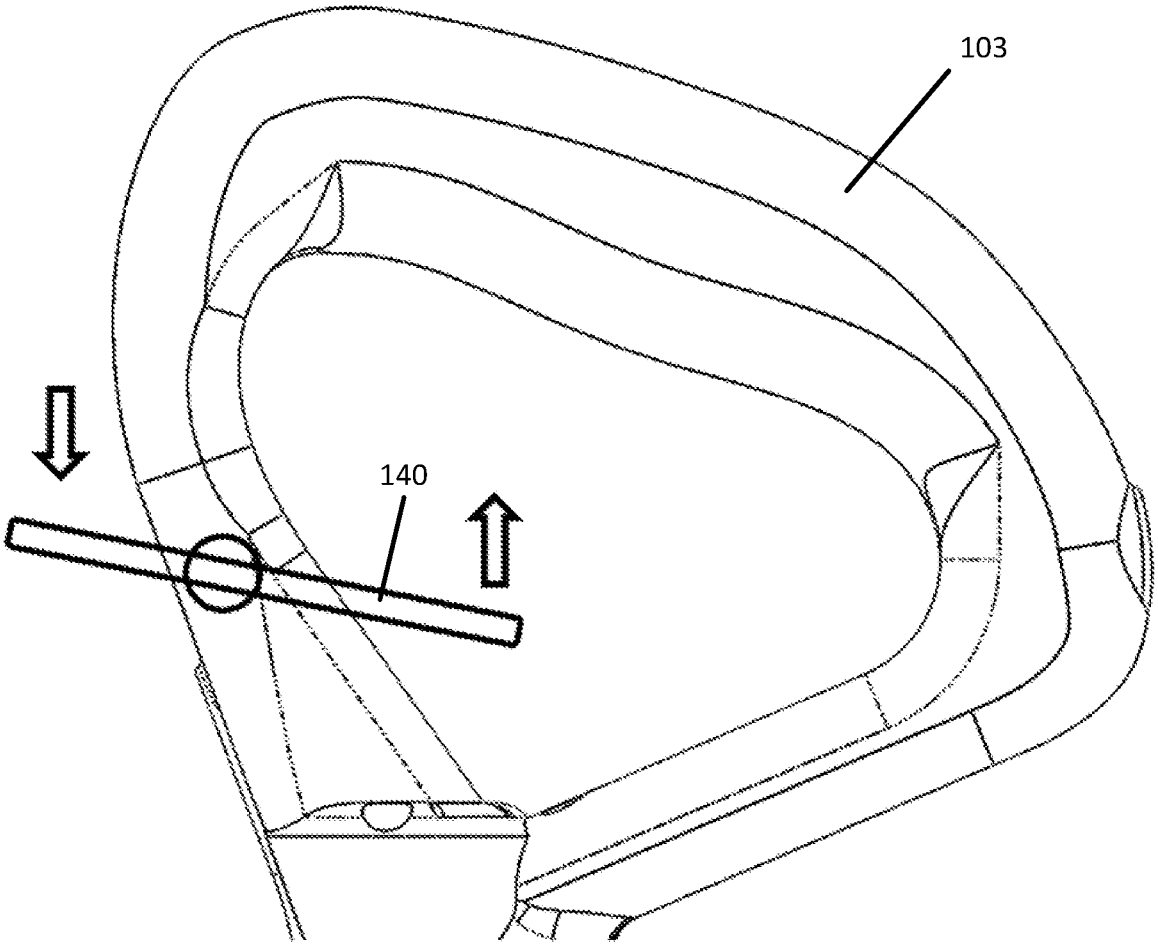
FIG. 14 illustrates a side view of a handle and latch mechanism of a vacuum cleaner, in accordance with an embodiment of the present disclosure.

FIG. 14 depicts an enlarged side view of the handle 103 showing the telescoping unlock paddle 140 in the handle 103, in accordance with an embodiment of the present disclosure. Moving the unlock paddle 140 between first (locked) and second positions (unlocked) allows locking or releasing the position of the vacuum cleaner 100 between extended and retracted.

Figure 15:
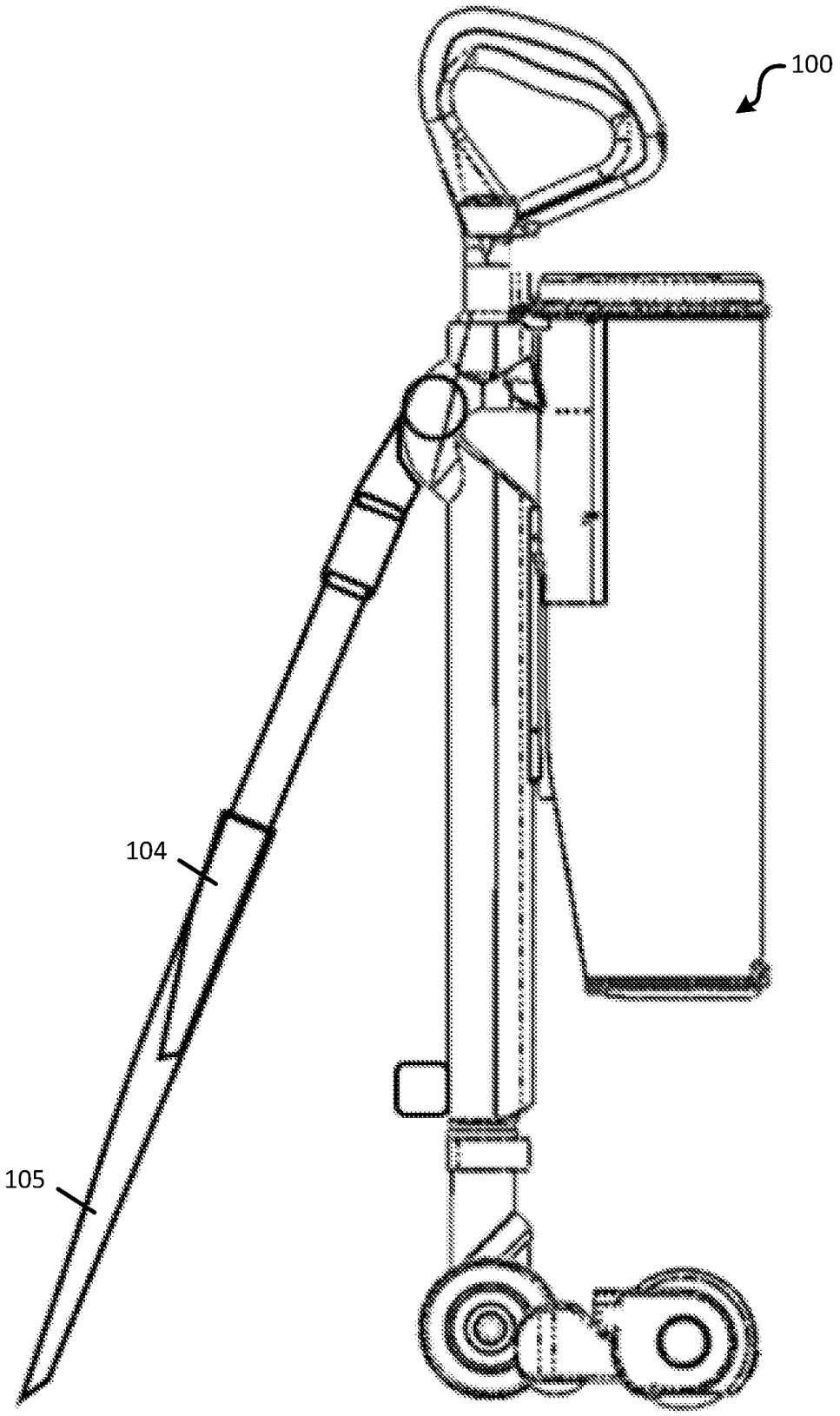
FIG. 15 illustrates a side view of a vacuum cleaner with the hand nozzle with nozzle extension in a deployed position, in accordance with an embodiment of the present disclosure.

FIG. 15 depicts a side view of the vacuum cleaner 100 assembly in baseboard mode, in accordance with an embodiment of the present disclosure. In this embodiment, the hand nozzle 104 is deployed and includes a nozzle extension 105 that is convenient for cleaning along baseboards, for example.

Figure 16:
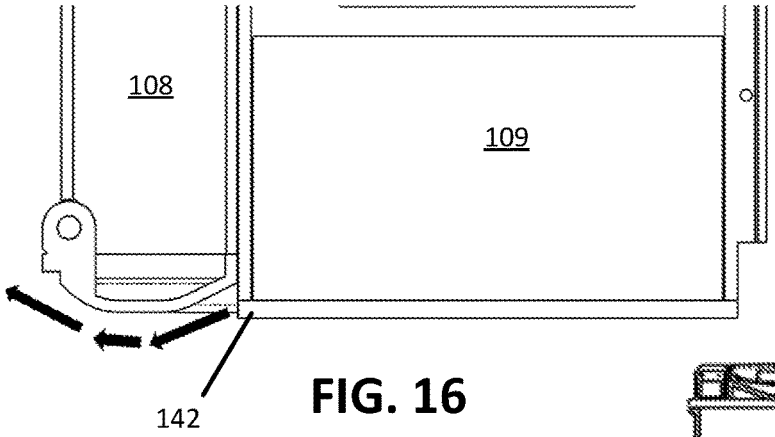
FIG. 16 illustrates a side view of part of a dustcup showing air flow according to a coanda effect, in accordance with an embodiment of the present disclosure.

FIG. 16 depicts an enlarged side view of a bottom portion of the centerpod 109 showing a hidden exhaust 142 at the bottom of the centerpod 109 with air flowing from the centerpod 109 according to a coanda effect caused by the curved base of the dustcup, in accordance with an embodiment of the present disclosure. In this embodiment, the hidden exhaust uses the coanda effect to direct air upwards.

Figure 17:
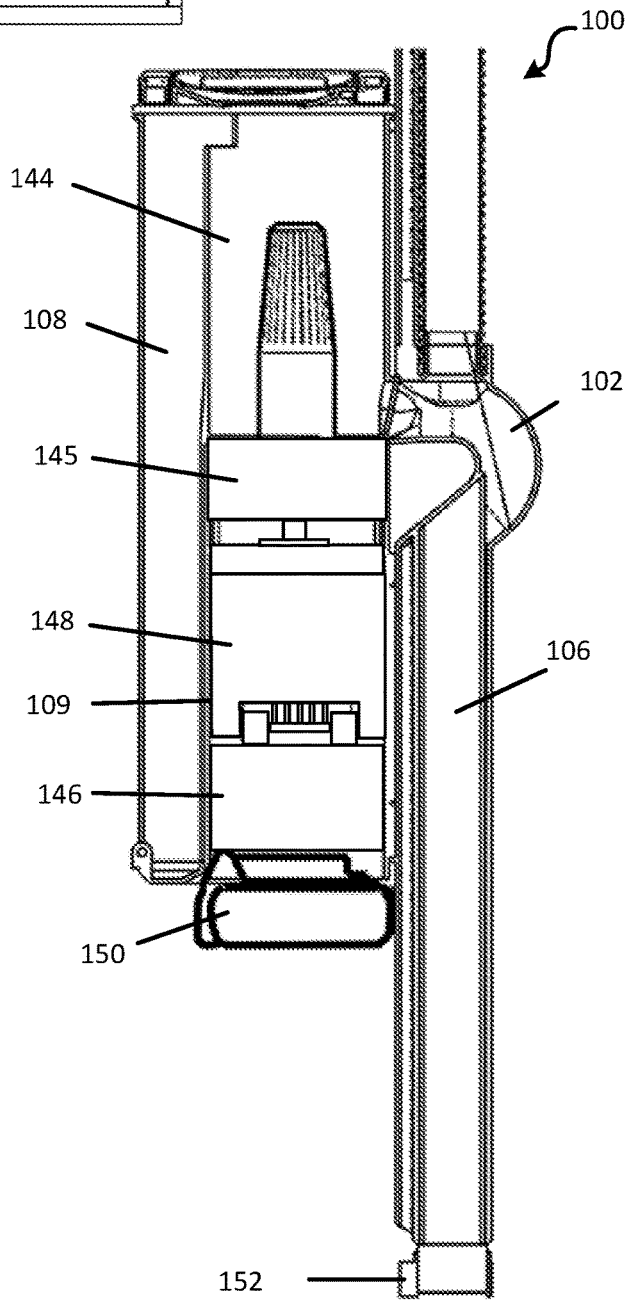
FIG. 17 illustrates a side vie of part of a vacuum cleaner, showing the dustcup and battery, in accordance with an embodiment of the present disclosure.

FIG. 17 depicts an enlarged side view showing the centerpod 109, backbone 106, gooseneck 102, and placements of the cyclone 144, filter 145, HEPA filter 146, and motor 148 within the centerpod 109 of the hybrid vacuum 100 cleaner, in accordance with an embodiment of the present disclosure. In this embodiment, the cyclone 144 is shown above the centerpod 109. The front to back clamshell construction of the centerpod 109 allows for a minimal diameter of the product, such as about 115 mm (4.5 inches). Also in this embodiment, the filter 146 placement is beneath the cyclone 144, the motor 148 is beneath the filter 145, the HEPA filter 146 is beneath the motor 148, and the removable battery 150 is beneath the HEPA filter 146. In this embodiment, the HEPA filter 146 is removed from the front, the rear clamshell is molded with the lower upduct and a bleed valve is between the motor and filter. Additionally, the vacuum cleaner assembly in this embodiment includes a telescoping catch 152. FIG. 17 also depicts the telescope catch 152 on the font side of the backbone 106 and the gooseneck airpath which has a large radius allowing for a smooth transition which reduces air flow and air watts losses.

Figure 18:
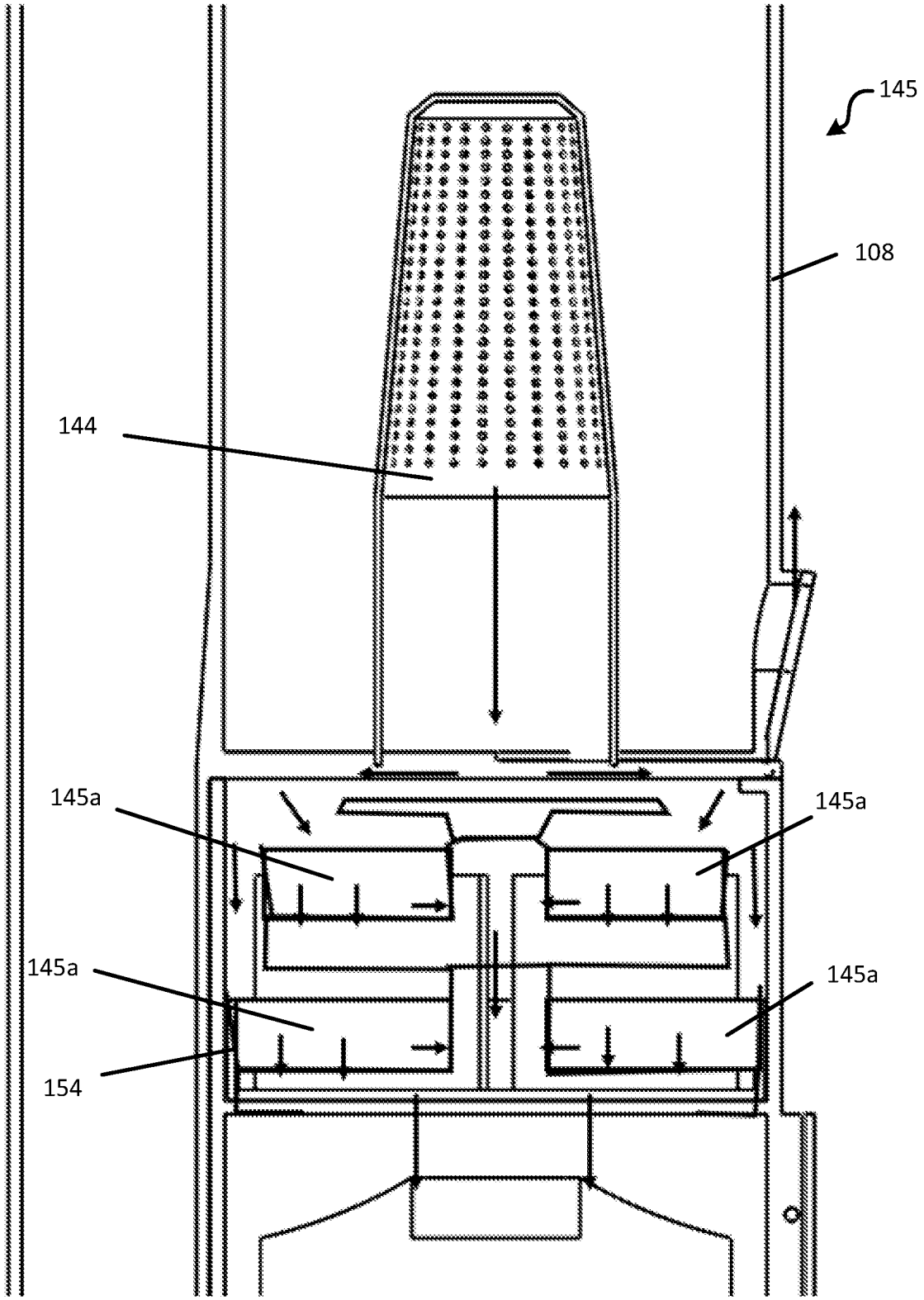
FIG. 18 illustrates example air flows in a dustcup of a vacuum cleaner, in accordance with an embodiment of the present disclosure.

FIG. 18 depicts an enlarged cross section of the filter 145 of the hybrid vacuum cleaner, in accordance with an embodiment of the present disclosure. In this embodiment, the filter 145 has multiple stacked flat foam filters 145*a*. In the embodiment illustrated in FIG. 18, the filter 145 has a 3-part filter holder construction. Embodiments of the present disclosure may have 2, 3, or more tiers of filters. FIG. 18 further depicts the direction of air flow through the cyclone 144 into the filter holder construction and through the filters 145*a* with directional arrows. The stacked foam filter structure gives the advantage of more filter area in a smaller diameter which reduces the pressure drop. In the embodiment illustrated in FIG. 18, a seal 154 is also shown which ensures air is directed through the filters 145*a*. The dustcup 108 can be removed for access to filters 145*a* for removal and cleaning.

Figure 19A:
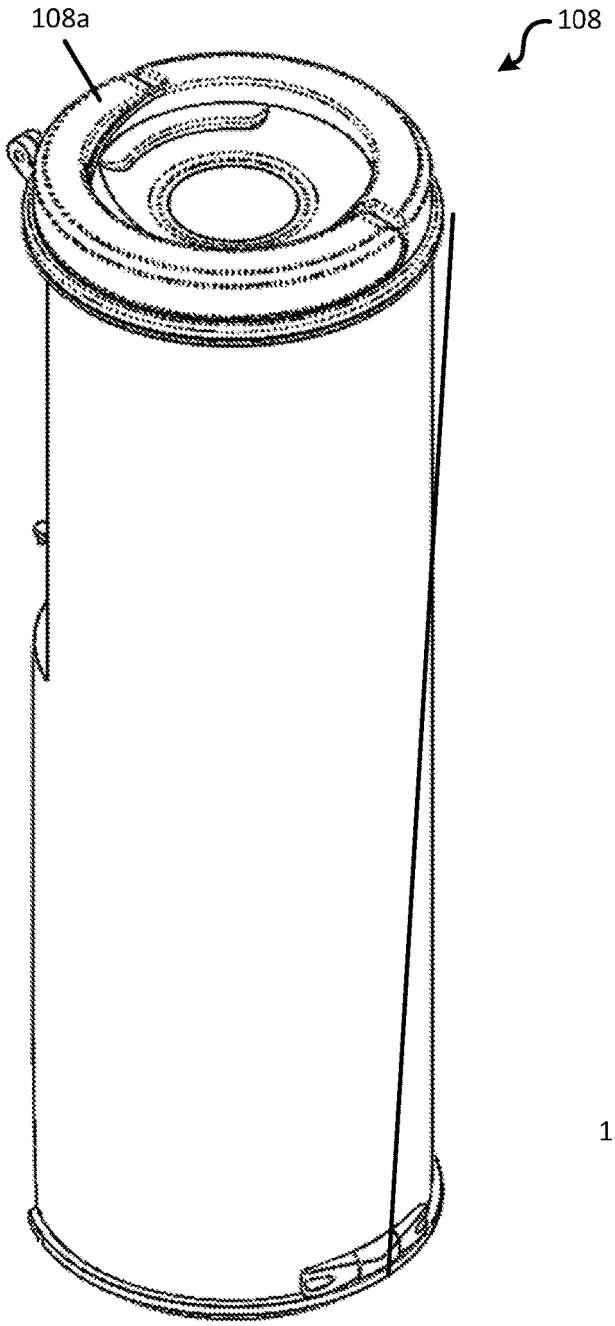
FIGS. 19A and 19B illustrate front and rear perspective views of a dustcup, in accordance with some embodiments of the present disclosure.
Figure 19B:
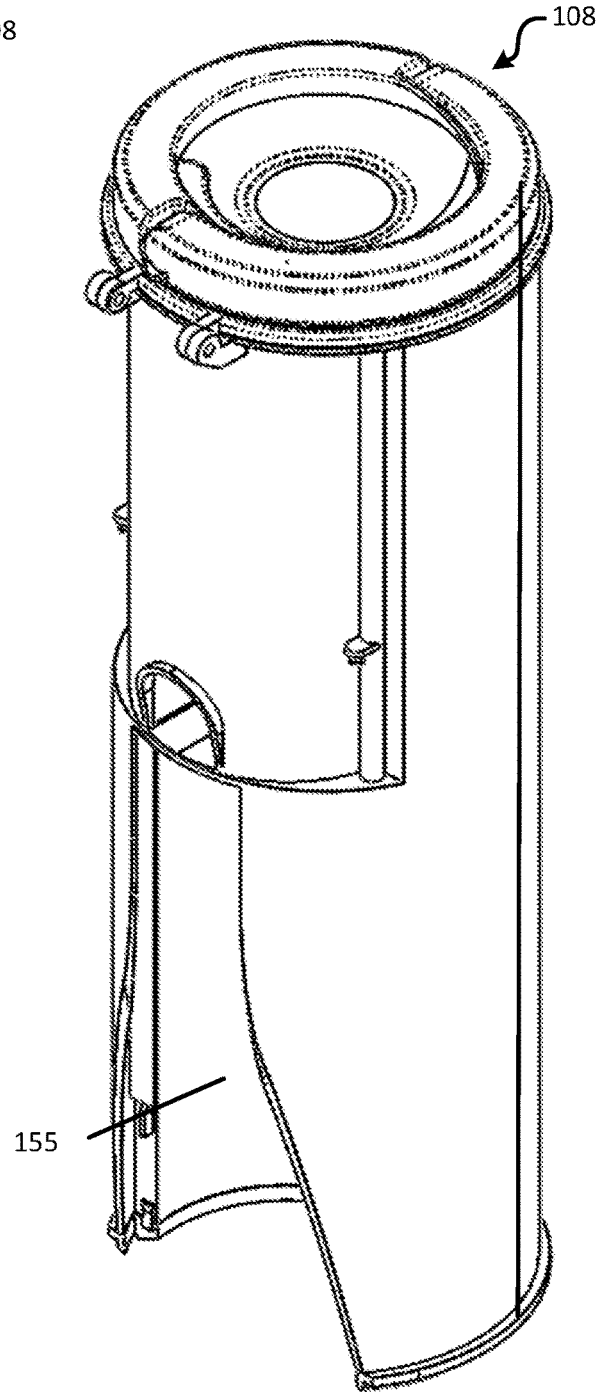

FIG. 19A depicts a front perspective view of the dustcup 108 and FIG. 19B depicts a rear perspective view of the dustcup 108, in accordance with an embodiment of the present disclosure. In this embodiment, the dustcup 108 is fully transparent with the exception of the ring around the lid 108*a*. The transparency enables a user to evaulate the unfilled capacity of the dustcup 108 without the need to open or remove the dustcup 108. The dustcup 108 provides a large capacity to minimize the frequency of emptying. As shown in the rear view of FIG. 19B, the dustcup 108 defines a cavity 155 to accommodate the centerpod 109.

Figure 20:
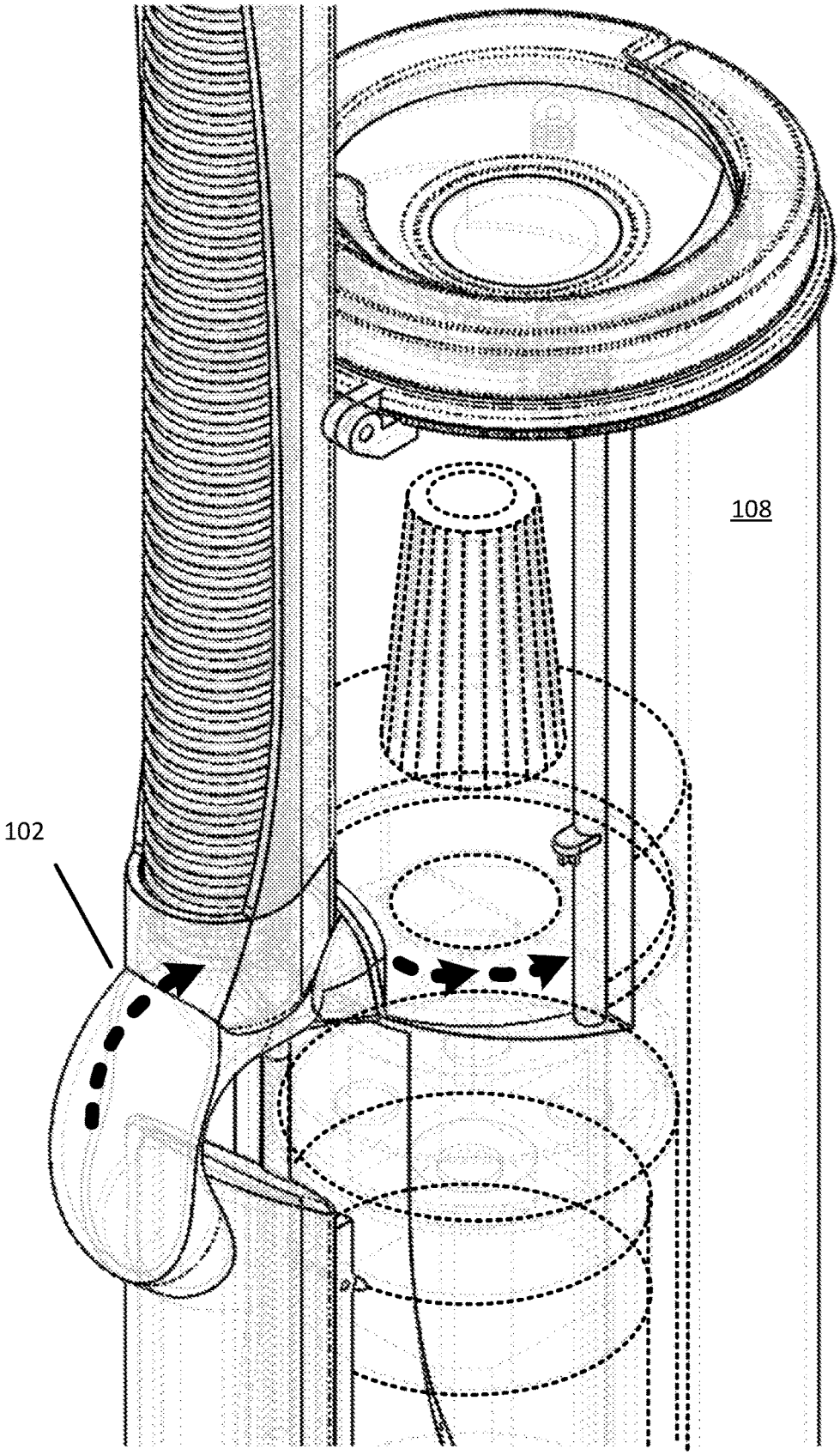
FIG. 20 illustrates a rear perspective view of part of a vacuum cleaner showing example air flow paths from the gooseneck and into the dustcup, in accordance with an embodiment of the present disclosure.

FIG. 20 depicts a rear perspective view of the central inlet of the dustcup 108, in accordance with an embodiment of the present disclosure. In this embodiment, air follows the path of the arrows from the gooseneck 102 through the central inlet into the dustcup 108.

Figure 21:
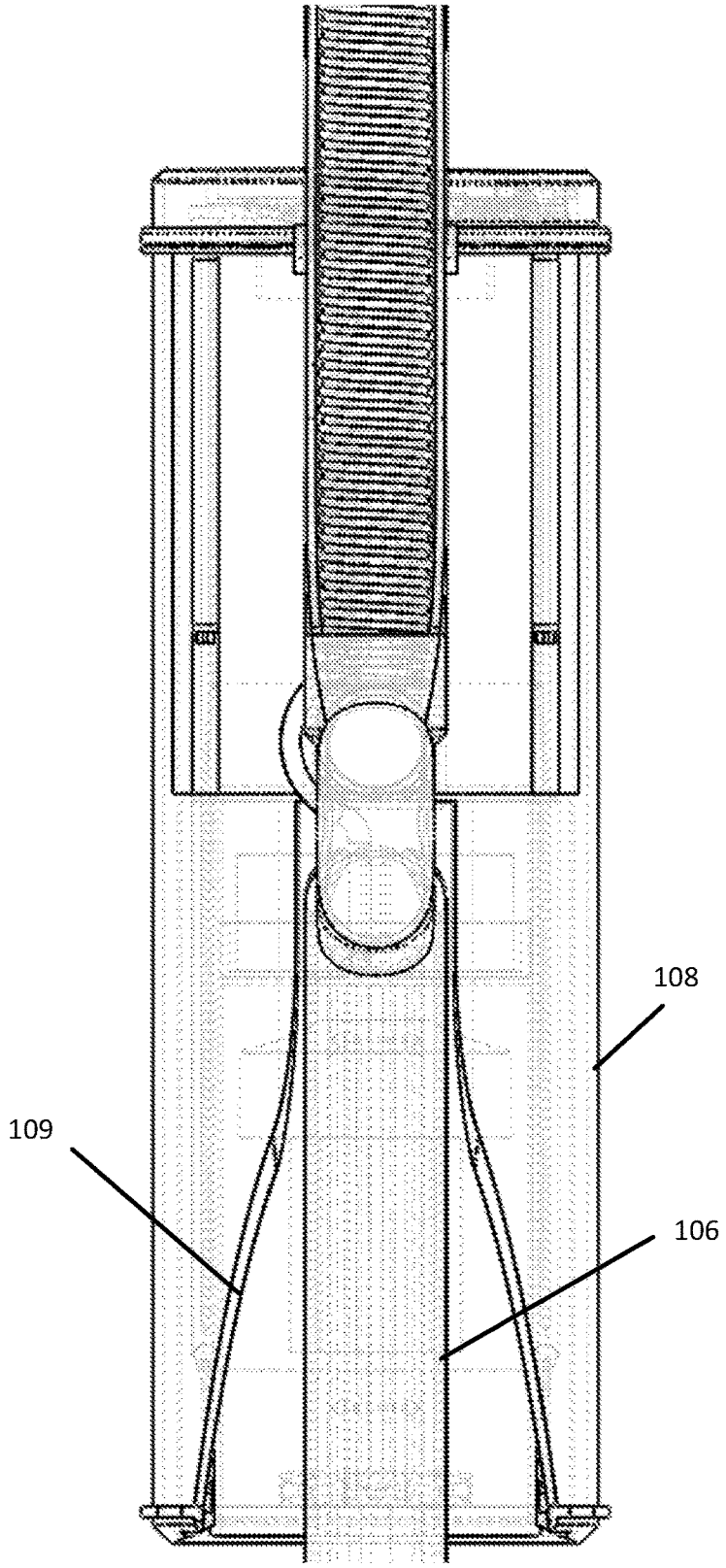
FIG. 21 illustrates a rear view of part of a vacuum cleaner and shows a backbone, dustcup, and flexible hose, in accordance with an embodiment of the present disclosure.

FIG. 21 depicts a rear view of the backbone 106 and top portion of the centerpod 109, in accordance with an embodiment of the present disclosure. In this embodiment, the backbone 106 is only 1.5 inches wide and the dustcup 108 has a total width of about 4.5 inches.

Figure 22A:
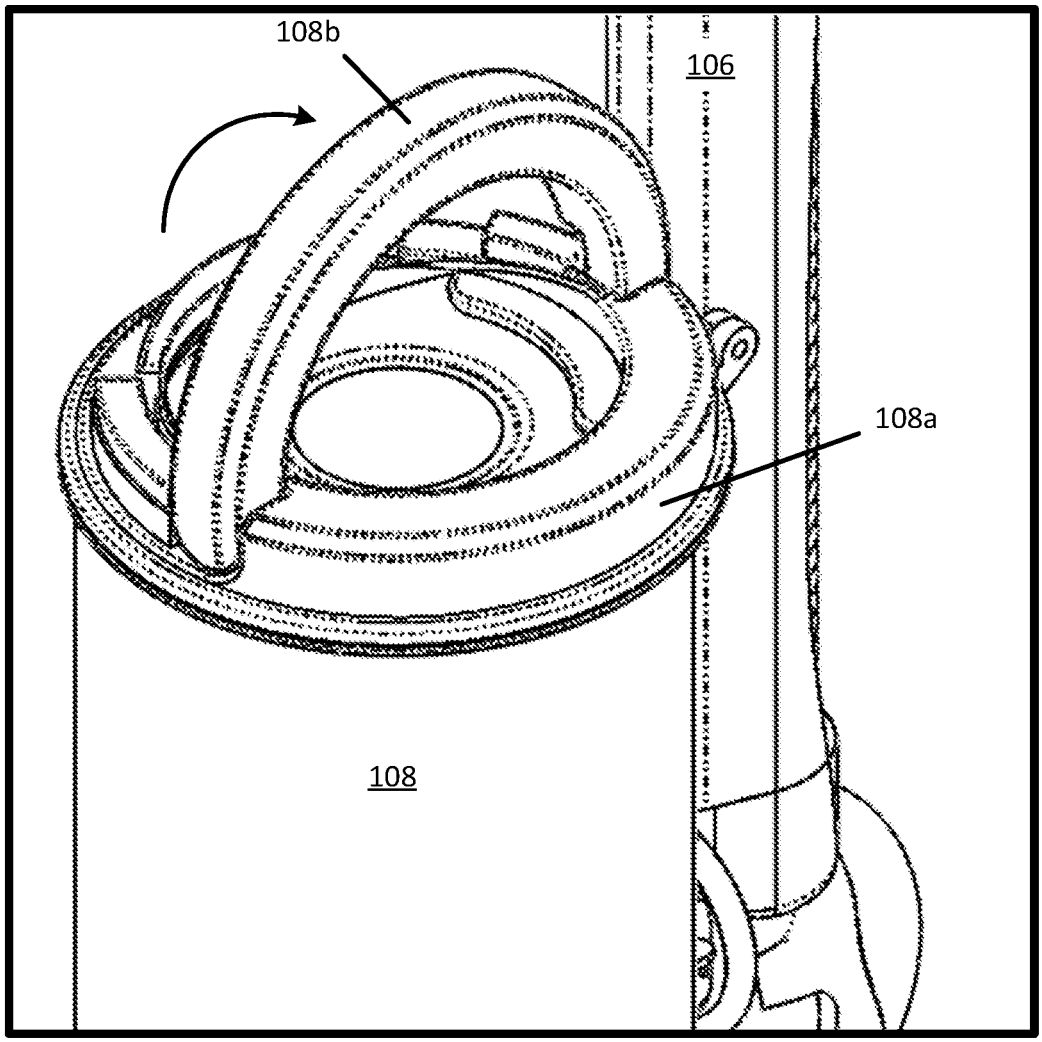
FIGS. 22A and 22B illustrate perspective views of a dustcup handle in an open position and a closed position, respectively, in accordance with some embodiments.
Figure 22B:
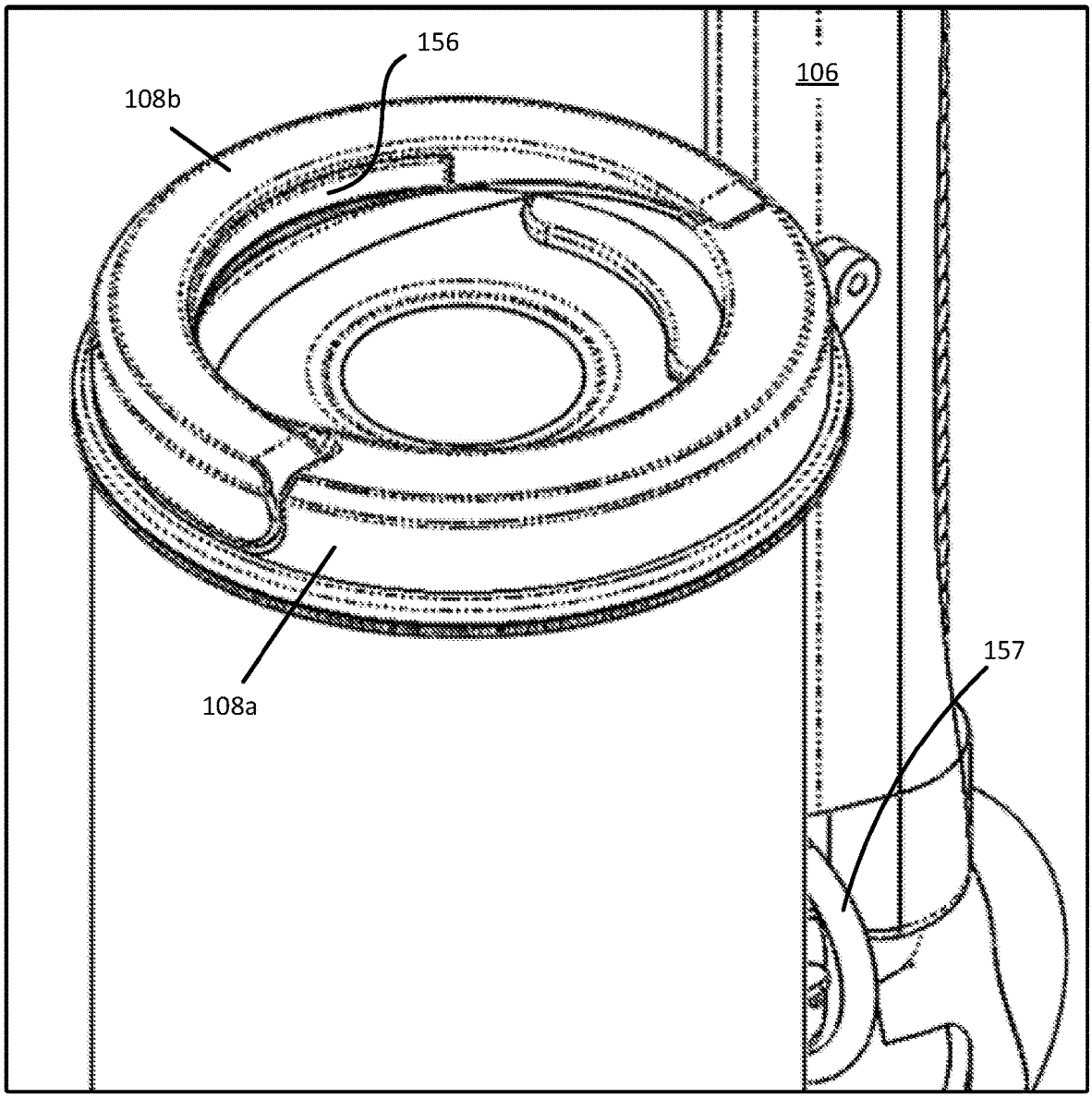
Figure 22C:
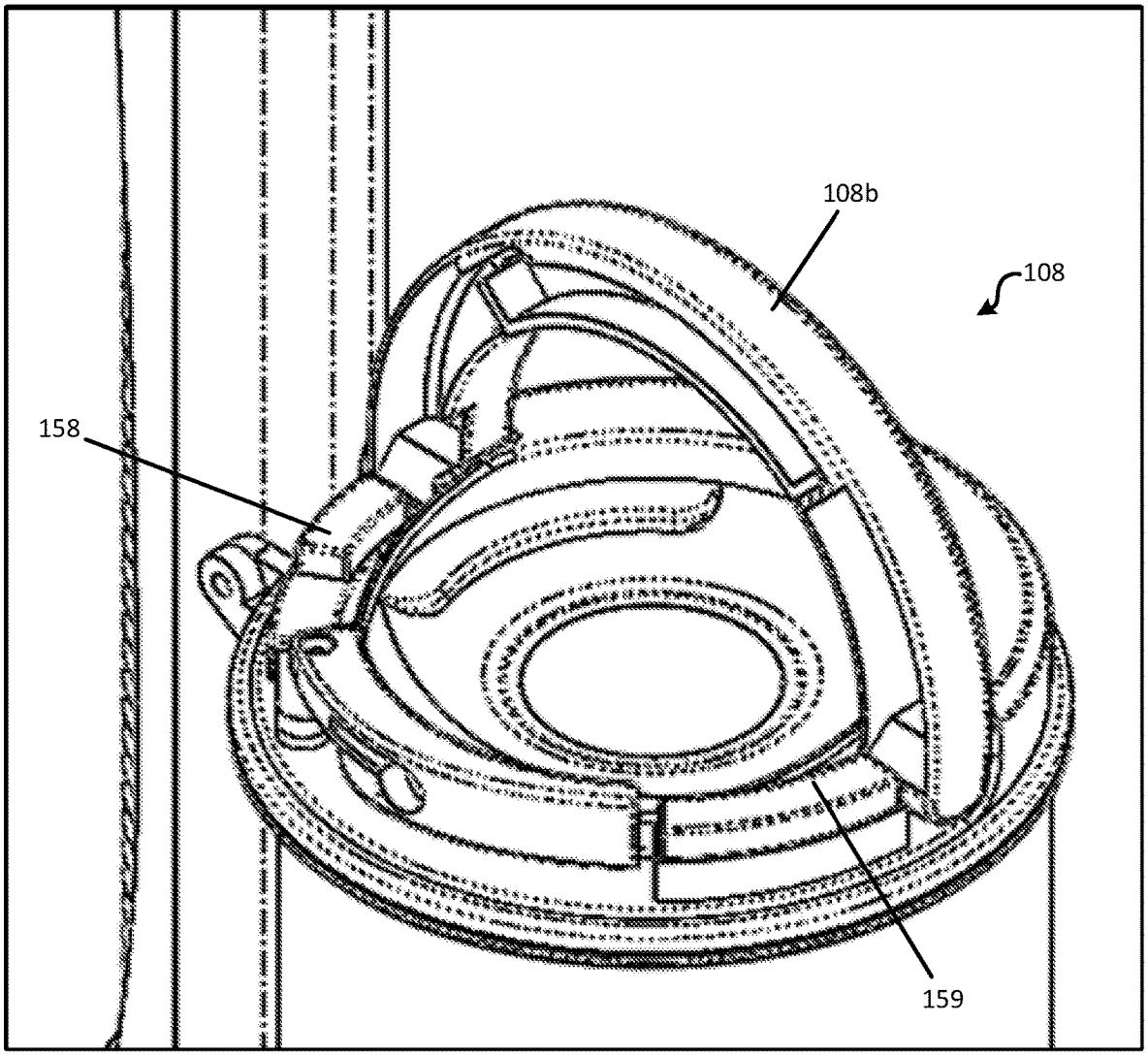
FIG. 22C illustrates a perspective view of the handle of FIG. 22A in an open position, showing a handle and dustcup release button on the handle, and a lid-release button and a dustcup-empty button on the top of the dustcup, in accordance with an embodiment of the present disclosure.

FIGS. 22A-22C depict enlarged perspective views of the top of the dustcup 108, the dustcup lid 108*a*, and the dustcup handle 108*b*, in accordance with an embodiment of the present disclosure. In this embodiment, a portion of the lid 108*a* hinges into an open position perpendicular with the lid 108*a* to function as a handle 108*b* as depicted in FIG. 22A. In FIG. 22B, the dustcup lid 108*a* is shown in the closed position. In the closed position, the handle 108*b* secures the dustcup 108 to the backbone 106. FIG. 22B also depicts the squeeze button 156 to unlock the dustcup handle 108*b* from the backbone 106 and the push rod 157 which allows a user to utilize the telescoping function of the vacuum cleaner assembly. FIG. 22C depicts the dustcup handle in the open position which exposes the dustcup empty button 158 and the lid release button 159 which are covered by the handle 108*b* when the handle is in the closed position.

Figure 23:
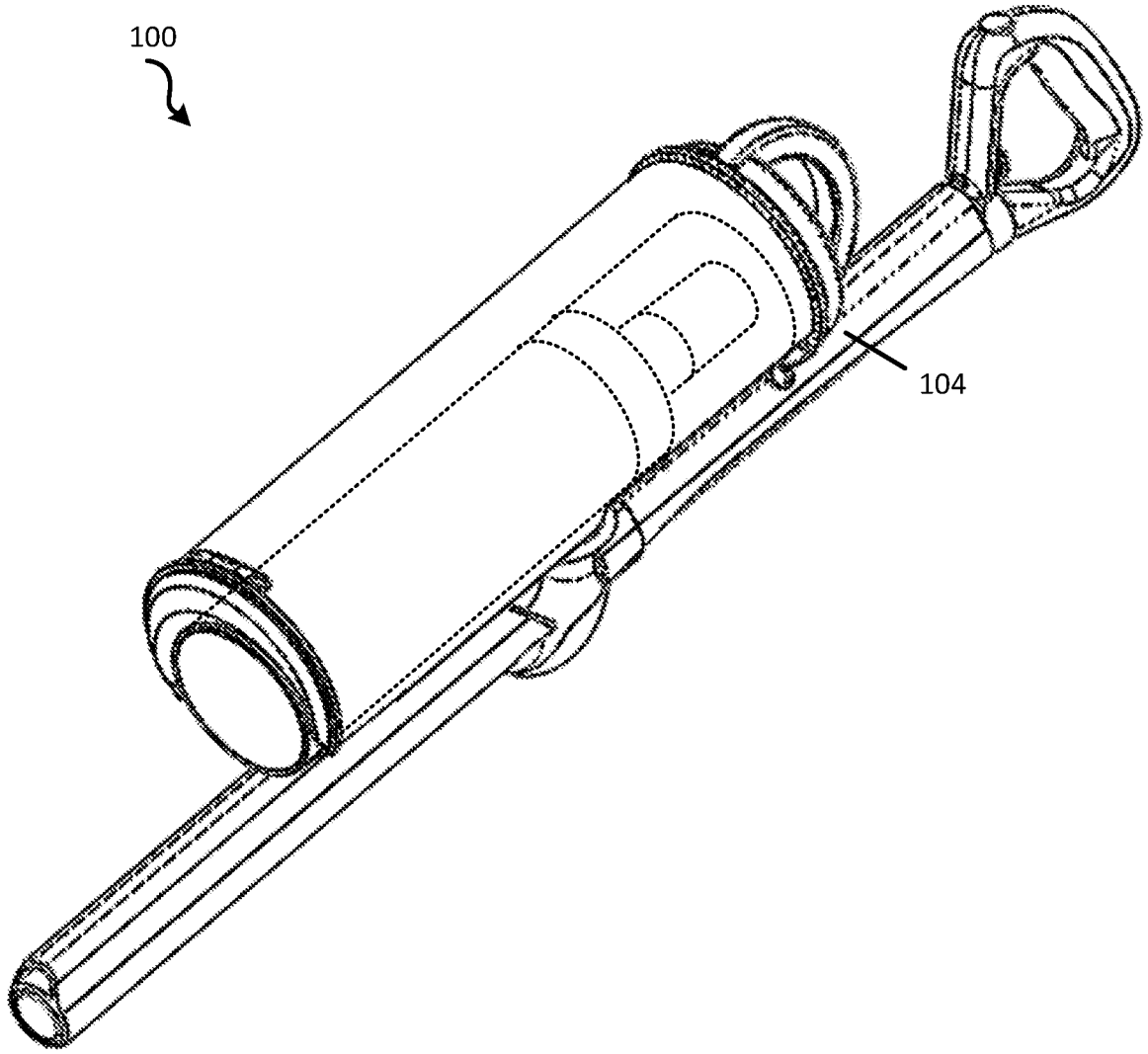
FIG. 23 illustrates a bottom perspective view of a backbone, a handle, and a dustcup of a vacuum cleaner, in accordance with some embodiments.

FIG. 23 depicts a perspective view of the upper portion of the vacuum cleaner 100 assembly in a retracted position, in accordance with an embodiment of the present disclosure. In this embodiment, the hand nozzle 104 of the vacuum cleaner 100 assembly can be rotated downward during use, thereby allowing a user to clean beneath obstacles such as furniture by extending the reach of vacuum cleaner to baseboards. In this embodiment, the telescope may be in an extended state or in a retracted state.

Further Considerations

The foregoing description of the embodiments of the disclosure has been presented for the purpose of illustration; it is not intended to be exhaustive or to limit the claims to the precise forms disclosed. Persons skilled in the relevant art can appreciate that many modifications and variations are possible in light of the above disclosure.

The language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the invention, which is set forth in the following claims.

What is claimed is:

1. A hybrid vacuum cleaner comprising:

a floor nozzle comprising:

a nozzle motor operable to rotate a brush roll axle, a brush roll on the brush roll axle, and a housing over the nozzle motor and over a top of the brush roll, the housing defining a nozzle outlet;

a power source in electrical communication with the nozzle motor; and a backbone above the floor nozzle, the backbone comprising:

a first tube having an upper end portion defining an outlet;

a second tube slidably positioned within the first tube, a lower end portion of the second tube connected to the nozzle outlet to define an air passageway to the outlet; and a handle on the backbone;

wherein the backbone is convertible between a retracted position in which the second tube is substantially contained within the first tube and the second tube closes the outlet of the first tube, and an extended position in which part of the first tube extends from the second tube and the outlet of the first tube is unobstructed by the second tube; and a centerpod attached to the backbone, the centerpod comprising:

a dustcup defining an inlet;

a conduit connecting the outlet of the first tube to the inlet of the dustcup; and a suction motor in the centerpod;

an auxiliary tube with a first end connected to the conduit and an open second end, the auxiliary tube movable between a stowed position and an use position; and a nozzle receptacle on the backbone, the nozzle receptacle configured to receive the open second end of the auxiliary tube and substantially block airflow through the auxiliary tube when the auxiliary tube is in the stowed position.

2. The hybrid vacuum cleaner assembly of claim 1 wherein the brush roll further comprises a cantilevered connection joint connecting the brush roll to the casing.

3. The hybrid vacuum cleaner assembly of claim 1 wherein the brush roll comprises at least one angled ridge configured to assist debris from the surface opening to the airpath of the floor nozzle.

* * * * *